US009618236B2

(12) United States Patent
Honda

(10) Patent No.: US 9,618,236 B2
(45) Date of Patent: Apr. 11, 2017

(54) HEAT PUMP SYSTEM

(75) Inventor: Masahiro Honda, Ostend (BE)

(73) Assignees: Daikin Industries, Ltd., Osaka (JP); DAIKIN EUROPE N.V., Oostende (BE)

( * ) Notice: Subject to any disclaimer, the term of this patent is extended or adjusted under 35 U.S.C. 154(b) by 1270 days.

(21) Appl. No.: 13/519,285

(22) PCT Filed: Dec. 28, 2009

(86) PCT No.: PCT/JP2009/007349

§ 371 (c)(1),
(2), (4) Date: Jun. 26, 2012

(87) PCT Pub. No.: WO2011/080801

PCT Pub. Date: Jul. 7, 2011

(65) Prior Publication Data

US 2012/0285186 A1 Nov. 15, 2012

(51) Int. Cl.
*F25B 1/00* (2006.01)
*F25B 49/00* (2006.01)
(Continued)

(52) U.S. Cl.
CPC ..... *F25B 7/00* (2013.01); *F25B 49/027* (2013.01); *F25B 13/00* (2013.01); *F25B 2339/047* (2013.01); *F25B 2500/12* (2013.01)

(58) Field of Classification Search
CPC .... F25B 7/00; F25B 49/027; F25B 2339/047; F25B 13/00; F25B 2500/12
See application file for complete search history.

(56) References Cited

U.S. PATENT DOCUMENTS 4,869,074 A * 9/1989 Hoshi ..... F24F 3/06 62/238.7
5,050,397 A * 9/1991 Sugiyama ..... F25B 13/00 62/158
(Continued)

FOREIGN PATENT DOCUMENTS

DE 2 309 337 A1 10/1973
JP 62-49160 A 3/1987
(Continued)

OTHER PUBLICATIONS

Eiichi et al., Tow-Stage Compression Type Freezing Device, Feb. 2, 1993, JPH0526524A, Whole Document.*
(Continued)

*Primary Examiner* — Larry Furdge
(74) *Attorney, Agent, or Firm* — Global IP Counselors, LLP

(57) ABSTRACT

A heat pump system includes a heat source unit, a usage-side unit, and a usage-side controller. The heat source unit has a heat source-side compressor for compressing a heat source-side refrigerant, and a heat source-side heat exchanger capable of functioning as an evaporator of the heat source-side refrigerant. The usage-side unit is connected to the heat source unit and has a capacity-variable-type usage-side compressor for compressing a usage-side refrigerant, a usage-side heat exchanger capable of functioning as a radiator of the heat source-side refrigerant and functioning as an evaporator of the usage-side refrigerant, and a refrigerant-water heat exchanger capable of functioning as a radiator of the usage-side refrigerant and heating an aqueous medium. The usage-side controller performs usage-side capacity variation control for incrementally varying the operating capacity of the usage-side compressor during a usual operation.

14 Claims, 9 Drawing Sheets

(51) Int. Cl.

| | |
|---|---|
| ***F25B 7/00*** | (2006.01) |
| ***F25B 49/02*** | (2006.01) |
| *F25B 13/00* | (2006.01) |

(56) References Cited

U.S. PATENT DOCUMENTS

| | | | | |
|---|---|---|---|---|
| 5,778,147 | A * | 7/1998 | Kim | F24F 13/06 392/473 |
| 6,131,401 | A * | 10/2000 | Ueno | A47F 3/04 165/208 |
| 6,324,856 | B1 * | 12/2001 | Weng | F25B 7/00 62/175 |

FOREIGN PATENT DOCUMENTS

| | | | |
|---|---|---|---|
| JP | S62184916 | A * | 8/1987 |
| JP | H0526524 | A * | 2/1993 |
| JP | H05142294 | A * | 6/1993 |
| JP | H0835738 | A * | 2/1996 |
| JP | 2000205672 | A * | 7/2000 |
| JP | 2002-61925 | A | 2/2002 |
| JP | 2003-314838 | A | 11/2003 |
| JP | 2008185321 | A * | 8/2008 |
| JP | WO-2008/117408 | A1 | 10/2008 |
| JP | 2009-229012 | A | 10/2009 |

OTHER PUBLICATIONS

Motoharu, Cooling Device Including Variable Displacement Compressor, Aug. 13, 1987, JPS62184916A, Whole Document.*

Ozeki et al., Thermal Shock Tester, Jun. 8, 1993, JPH05142294A, Whole Document.*

Isao et al., Refrigerating System, Jul. 28, 2000, JP2000205672A, Whole Document.*

Tomoatsu et al., Air Conditioner, Aug. 14, 2008, JP2008185321A, Whole Document.*

Tomio et al., Constant Temperature Controller and Constant Temperature Controlling Method, Feb. 6, 1996, JPH0835738A, Whole Document.*

International Search Report of corresponding PCT Application No. PCT/JP2009/007349.

International Preliminary Report of corresponding PCT Application No. PCT/JP2009/007349.

European Search Report of corresponding EP Application No. 09 84 5945.6 dated Jun. 8, 2016.

* cited by examiner

HEAT PUMP SYSTEM

TECHNICAL FIELD

The present invention relates to a heat pump system, and particularly relates to a heat pump system in which an aqueous medium can be heated using a heat pump cycle.

BACKGROUND ART

In conventional practice, there have been heat pump-type warm-water heating apparatuses in which water can be heated using a heat pump cycle, such as the apparatus disclosed in Japanese Laid-open Patent Application No, 2003-314838. The heat pump-type warm-water heating apparatus comprises primarily an outdoor unit having a capacity-variable-type heat source-side compressor and a heat source-side heat exchanger, and a warm-water supply unit having a refrigerant-water heat exchanger and a circulation pump. The heat source-side compressor, the heat source-side heat exchanger, and the refrigerant-water heat exchanger constitute a heat source-side refrigerant circuit. With this heat pump-type warm-water heating apparatus, water is heated by the heat radiation of refrigerant in the refrigerant-water heat exchanger. The warn' water thus obtained is increased in pressure by the circulation pump, then stored in a tank or supplied to various aqueous medium devices.

SUMMARY

Technical Problem

The conventional heat pump-type hot-water supply apparatus described above requires the use of a radiator as an aqueous medium device, which must be supplied with high-temperature warm water. To extract the high-temperature warm water and supply it to an aqueous medium device, a considerable possibility is to provide a usage-side refrigerant circuit, separate from the heat source-side refrigerant circuit, within the warm-water supply unit. However, the usage-side refrigerant circuit has a capacity-variable-type compressor similar to the heat source-side refrigerant circuit, and when the capacity of this compressor is suddenly varied, noise accompanying the capacity variation is emitted from the compressor. Therefore, when the warm-water supply unit is disposed indoors, a user indoors hears the harsh noise emitted from the compressor.

In view of this, an object of the present invention is to prevent the noise emitted when the capacity of the compressor varies from being harsh to the user in cases in which a unit disposed indoors has a capacity-variable-type compressor.

Solution to Problem

A heat pump system according to a first aspect of the present invention comprises a heat source unit, a usage-side unit, and a usage-side controller. The heat source unit has a heat source-side compressor and a heat source-side heat exchanger. The heat source-side compressor compresses a heat source-side refrigerant. The heat source-side heat exchanger is capable of functioning as an evaporator of the heat source-side refrigerant. The usage-side unit is connected to the heat source unit. The usage-side unit has a usage-side compressor, a usage-side heat exchanger, and a refrigerant-water heat exchanger, constituting a heat source-side refrigerant circuit and a usage-side refrigerant circuit. The usage-side compressor is a capacity-variable-type compressor for compressing a usage-side refrigerant. The usage-side heat exchanger is capable of functioning as a radiator of the heat source-side refrigerant and functioning as an evaporator of the usage-side refrigerant. The refrigerant-water heat exchanger is capable of functioning as a radiator of the usage-side refrigerant and heating an aqueous medium. The heat source-side refrigerant circuit is configured from the heat source-side compressor, the heat source-side heat exchanger, and the usage-side heat exchanger. The usage-side refrigerant circuit is configured from the usage-side compressor, the usage-side heat exchanger, and the refrigerant-water heat exchanger. The usage-side controller is capable of performing a usage-side capacity variation control for incrementally varying the operating capacity of the usage-side compressor during a normal operation.

According to the above heat pump system, for example, the heat source unit is installed outdoors and the usage-side unit is installed indoors. In other words, the usage-side unit, which has the usage-side compressor which is a source of noise, is installed indoors. However, in this heat pump system, during the usual operation, the operating capacity of the usage-side compressor varies not suddenly but incrementally. Therefore, the noise outputted from this compressor is emitted slowly; due to the incremental varying of the operating capacity of the compressor. Consequently, it is possible to prevent the noises emitted along with the varying of the operating capacity from being harsh.

A heat pump system according to a second aspect of the present invention is the heat pump system according to the first aspect, wherein the usage-side controller performs a capacity control on the usage-side compressor so that the condensation temperature of the usage-side refrigerant in the refrigerant-water heat exchanger reaches a usage-side condensation target temperature, and also performs the usage-side capacity variation control by incrementally varying the usage-side condensation target temperature.

According to the above heat pump system, the operating capacity of the usage-side compressor is incrementally varied by incrementally varying the usage-side condensation target temperature during the usage-side capacity variation control. Therefore, the operating capacity of the usage-side compressor can be incrementally varied by a simple method.

A heat pump system according to a third aspect of the present invention is the heat pump system according to the first or second aspect, wherein the usage-side controller performs the usage-side capacity variation control during a predetermined time duration following the start of operation of the usage-side compressor.

When the usage-side compressor begins operating, the rotational speed of the compressor increases, but noise is also emitted along with this increase in rotational speed. In view of this, in this heat pump system, the operating capacity of the usage-side compressor is incrementally varied during a predetermined time duration from the start of operation of the usage-side compressor, i.e., during the time period in which the rotational speed of the compressor is increasing. The rotational speed of the usage-side compressor thereby gradually increases along with the variation of the operating capacity, and the sudden emission of loud noise can be suppressed.

A heat pump system according to a fourth aspect of the present invention is the heat pump system according to any of the first through third aspects, wherein the heat source-side compressor is a capacity-variable-type compressor. The heat pump system further comprises a heat source-side controller. The heat source-side controller can perform heat source-side capacity variation control for incrementally varying the operating capacity of the heat source-side compressor when the usage-side controller is performing the usage-side capacity variation control.

According to the above heat pump system, when the usage-side capacity variation control is being performed for incrementally varying the operating capacity of the usage-side compressor, the operating capacity incrementally varies not only in the usage-side compressor but in the heat source-side compressor as well. Therefore, a balance can be maintained between the capability of the usage-side compressor and the capability of the heat source-side compressor.

A heat pump system according to a fifth aspect of the present invention is the heat pump system according to the fourth aspect, wherein the heat source-side controller performs capacity control on the heat source-side compressor so that the evaporation temperature of the usage-side refrigerant in the usage-side heat exchanger reaches a usage-side evaporation target temperature, and also performs the heat source-side capacity variation control by incrementally varying the usage-side evaporation target temperature. Otherwise, the heat source-side controller performs capacity control on the heat source-side compressor so that the condensation temperature of the heat source-side refrigerant in the usage-side heat exchanger reaches a heat source-side condensation target temperature, and also performs the heat source-side capacity variation control by incrementally varying the heat source-side condensation target temperature.

According to the above heat pump system, the operating capacity of the heat source-side compressor is incrementally varied by incrementally varying either the usage-side evaporation target temperature in the usage-side refrigerant or the heat source-side condensation target temperature in the heat source-side refrigerant. Therefore, the operating capacity of the heat source-side compressor can be incrementally varied by a simple method.

A heat pump system according to a sixth aspect of the present invention is the heat pump system according to the fifth aspect, wherein in a case in which the usage-side controller reduces the operating capacity of the usage-side compressor during the usage-side capacity variation control, the heat source-side controller performs the heat source-side capacity variation control for increasing the operating capacity of the heat source-side compressor by raising the heat source-side condensation target temperature.

According to the above heat pump system, when the operating capacity of the usage-side compressor decreases, the operating capacity of the heat source-side compressor is increased by raising the heat source-side condensation target temperature. Thereby, even when the compressor capability decreases in the usage-side unit, the capability of the entire system can be maintained by raising the compressor capability of the heat source unit.

A heat pump system according to a seventh aspect of the present invention is the heat pump system according to the sixth aspect, wherein the usage-side controller limits the operating capacity of the usage-side compressor to a predetermined capacity or lower during the usage-side capacity variation control. Furthermore, the usage-side controller is also capable of performing capacity non-limiting control for controlling the operating capacity of the usage-side compressor without limiting the operating capacity to the predetermined capacity or lower after the usage-side capacity variation control. The heat source-side controller performs a control for reducing the operating capacity of the heat source-side compressor during the capacity non-limiting control by lowering the heat source-side condensation target temperature to a value lower than during the usage-side capacity variation control.

According to the above heat pump system, the operating capability of the usage-side compressor is limited to the predetermined amount or lower during the usage-side capacity variation control, but during the capacity non-limiting control performed after the usage-side capacity variation control, the operating capacity of the usage-side compressor ceases to be limited and increases. Therefore, the compressor capability of the usage-side unit can be ensured in the usage-side unit. Consequently, a balance of compressor capability in the entire heat pump system can be maintained in this case by reducing the operating capacity of the heat source-side compressor.

A heat pump system according to an eighth aspect of the present invention is the heat pump system according to the fifth aspect, wherein in cases in which the usage-side controller reduces the operating capacity of the usage-side compressor during the usage-side capacity variation control, the heat source-side controller performs the heat source-side capacity variation control for increasing the operating capacity of the heat source-side compressor by raising the usage-side evaporation target temperature.

According to the above heat pump system, when the operating capacity of the usage-side compressor decreases, the operating capacity of the heat source-side compressor is increased by raising the usage-side evaporation target temperature. Thereby, even when the compressor capability decreases in the usage-side unit, the compressor capability of the entire system can be maintained by raising the compressor capability of the heat source unit.

A heat pump system according to a ninth aspect of the present invention is the heat pump system according to the eighth aspect, wherein the usage-side controller limits the operating capacity of the usage-side compressor to a predetermined capacity or tower during the usage-side capacity variation control. Furthermore, the usage-side controller is also capable of performing capacity non-limiting control for controlling the operating capacity of the usage-side compressor without limiting the operating capacity to the predetermined capacity or tower after the usage-side capacity variation control. The heat source-side controller performs a control for reducing the operating capacity of the heat source-side compressor during the capacity non-limiting control by lowering the usage-side evaporation target temperature to a value lower than during the usage-side capacity variation control.

According to the above heat pump system, the operating capability of the usage-side compressor is limited to the predetermined amount or lower during the usage-side capacity variation control, but during the capacity non-limiting control performed after the usage-side capacity variation control, the operating capacity of the usage-side compressor ceases to be limited and increases. Therefore, the compressor capability of the usage-side unit can be ensured in the usage unit alone. Consequently, a balance of compressor capability in the entire heat pump system can be maintained in this case by reducing the operating capacity of the heat source-side compressor.

A heat pump system according to a tenth aspect of the present invention is the heat pump system according to any of the fifth through ninth aspects, wherein the usage-side controller performs the usage-side capacity variation control during a predetermined time duration following the start of operation of the usage-side compressor. The heat source-side controller sets the usage-side evaporation target temperature or the heat source-side condensation target temperature to a predetermined temperature or higher at the start of operation of the usage-side compressor. The heat source-side controller thereafter incrementally lowers the usage-side evaporation target temperature or the heat source-side condensation target temperature until the predetermined temperature is reached.

Generally, when the usage-side compressor begins operating, the operating capacity of the usage-side compressor must be suddenly increased in order to start up the heat pump system, but in the present invention, sudden increases in the operating capacity are suppressed in order to prevent noise. Therefore, the compressor capability of the entire system at startup is suppressed. In view of this, according to the above heat pump system, the usage-side evaporation target temperature or the heat source-side condensation target temperature is temporarily raised to a predetermined temperature or higher in the heat source unit at the start of operation of the usage-side compressor, and control is thereafter performed for incrementally lowering the usage-side evaporation target temperature or the heat source-side condensation target temperature. In other words, when the usage-side compressor begins operating, the capability of the heat source-side compressor in the heat source unit gradually decreases after having temporarily increased. Thereby, when the system starts up, even if the sudden increase in the operating capacity of the usage-side compressor has been suppressed in order to prevent noise, the capability insufficiency in the usage-side unit can be compensated in the side having the heat source unit. Therefore, the system can be reliably started up while preventing the noise outputted from the usage-side compressor from being harsh.

A heat pump system according to an eleventh aspect of the present invention is the heat pump system according to any of the first through tenth aspects, further comprising a receiver. The receiver is capable of receiving a command to initiate the usage-side capacity variation control. The usage-side controller performs the usage-side capacity variation control when the receiver has received the command to initiate the usage-side capacity variation control.

According to the above heat pump system, when a command to initiate the usage-side capacity variation control has been issued via a remote controller, for example, and the operating state of the system has changed, the operating capacity of the usage-side compressor varies incrementally. Therefore, this heat pump system can perform an operation for suppressing the noise outputted from the usage-side compressor in accordance with the preferences of the user who is using the system.

Advantageous Effects of Invention

As stated in the above descriptions, the following effects are obtained according to the present invention.

With the heat pump system according to the first aspect, it is possible to prevent the noises emitted along with the varying of the operating capacity from being harsh.

With the heat pump system according to the second aspect, the operating capacity of the usage-side compressor can be incrementally varied by a simple method.

With the heat pump system according to the third aspect, when the usage-side compressor begins operating, the operating capacity of the usage-side compressor incrementally varies, and the rotational speed of the usage-side compressor therefore also gradually increases. Therefore, the sudden emission of loud noise can be suppressed when the usage-side compressor begins operating.

With the heat pump system according to the fourth aspect, when the usage-side capacity variation control is being performed for incrementally varying the operating capacity of the usage-side compressor, the operating capacity incrementally varies not only in the usage-side compressor but in the heat source-side compressor as well. Therefore, a balance can be maintained between the capability of the usage-side compressor and the capability of the heat source-side compressor.

With the heat pump system according to the fifth aspect, the operating capacity of the heat source-side compressor is incrementally varied by incrementally varying either the usage-side evaporation target temperature in the usage-side refrigerant or the heat source-side condensation target temperature in the heat source-side refrigerant. Therefore, the operating capacity of the heat source-side compressor can be incrementally varied by a simple method.

With the heat pump system according to the sixth aspect, even when the compressor capability decreases in the usage-side unit, the capability of the entire system can be maintained by raising the compressor capability of the heat source unit.

With the heat pump system according to the seventh aspect, a balance of compressor capability in the entire heat pump system can be maintained.

With the heat pump system according to the eighth aspect, even when the compressor capability decreases in the usage-side unit, the compressor capability of the entire system can be maintained by raising the compressor capability of the heat source unit.

With the heat pump system according to the ninth aspect, a balance of compressor capability in the entire heat pump system can be maintained.

With the heat pump system according to the tenth aspect, when the system starts up, even if the sudden increase in the operating capacity of the usage-side compressor has been suppressed in order to prevent noise, the capability insufficiency in the usage-side unit can be compensated in the side having the heat source unit. Therefore, the system can be reliably started up while preventing the noise outputted from the usage-side compressor from being harsh.

The heat pump system according to the eleventh aspect can perform an operation for suppressing the noise outputted from the usage-side compressor in accordance with the preferences of the user who is using the system.

DESCRIPTION OF EMBODIMENTS

An embodiment of a heat pump system according to the present invention is described hereinbelow based on the accompanying drawings.

<Configuration>

—Entire Structure—

Figure 1:
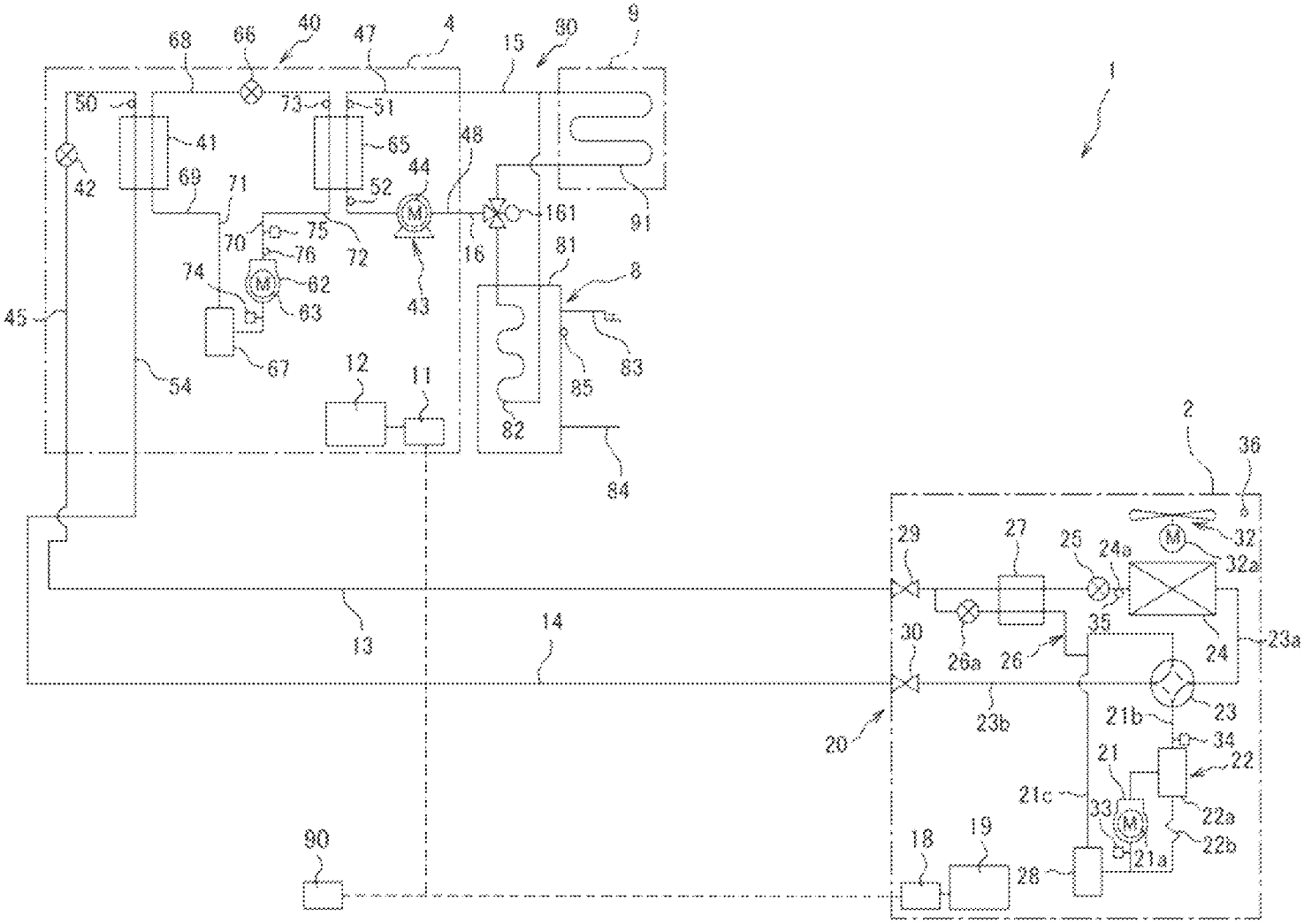
FIG. 1 is a schematic configuration view of a heat pump system according to the present embodiment.

FIG. 1 is a schematic configuration view of a heat pump system 1 according to an embodiment of the present invention. The heat pump system 1 is an apparatus capable of performing an operation, for example, for heating an aqueous medium by using a vapor compressor-type heat pump cycle.

The heat pump system 1 comprises primarily a heat source unit 2, a usage-side unit 4, a liquid refrigerant communication tube 13, a gas refrigerant communication tube 14, a hot-water storage unit 8, a warm-water heating unit 9, aqueous medium communication tubes 15, 16, a usage-side correspondence unit 11, a usage-side controller 12, a heat source-side correspondence unit 18, a heat source-side controller 19, and a remote controller 90. The heat source unit 2 and the usage-side unit 4 are connected to each other via the liquid refrigerant communication tube 13 and the gas refrigerant communication tube 14, thereby constituting a heat source-side refrigerant circuit 20. Specifically, the heat source-side refrigerant circuit 20 is configured primarily from a heat source-side compressor 21 (described hereinafter), a heat source-side heat exchanger 24 (described hereinafter), and a usage-side heat exchanger 41 (described hereinafter). A usage-side refrigerant circuit 40 is configured within the usage-side unit 4 primarily by a usage-side compressor 62 (described hereinafter), the usage-side heat exchanger 41 (described hereinafter), and a refrigerant-water heat exchanger 65 (described hereinafter). The usage-side unit 4, the hot-water storage unit 8, and the warm-water heating unit 9 are connected via the aqueous refrigerant communication tubes 15, 16, thereby constituting an aqueous medium circuit 80.

Enclosed inside the heat source-side refrigerant circuit 20 are HFC-410A as a heat source-side refrigerant, which is an HFC-based refrigerant and an ester-based or ether-based refrigerating machine oil which is compatible with the HFC-based refrigerant and which is enclosed in order to lubricate the heat source-side compressor 21 (described hereinafter). Enclosed inside the usage-side refrigerant circuit 40 are HFC-134a as a usage-side refrigerant, which is a type of HFC-based refrigerant and an ester-based or ether-based refrigerating machine oil which is compatible with the HFC-based refrigerant and which is enclosed in order to lubricate the usage-side compressor 62 (described hereinafter). From the viewpoint of using a refrigerant that is advantageous in a high-temperature refrigeration cycle, it is preferable for the usage-side refrigerant to use refrigeration whose pressure at a saturated gas temperature of 65° C. is a high gauge pressure of 2.8 MPa or less, or preferably 2.0 MPa or less. The HFC-134a is a type of refrigerant having saturated pressure characteristics such as these. Water as an aqueous medium circulates through the aqueous medium circuit 80.

—Heat Source Unit—

The heat source unit 2 is installed outdoors. The heat source unit 2 is connected to the usage-side unit 4 via the liquid refrigerant communication tube 13 and the gas refrigerant communication tube 14, and the heat source unit 2 constitutes part of the heat source-side refrigerant circuit 20.

The heat source unit 2 has primarily the heat source-side compressor 21, an oil separation mechanism 22, a heat source-side switching mechanism 23, the heat source-side heat exchanger 24, a heat source-side expansion valve 25, an intake return tube 26, a supercooler 27, a heat source-side accumulator 28, a liquid-side shut-off valve 29, and a gas-side shut-off valve 30.

The heat source-side compressor 21 is a mechanism for compressing the heat source-side refrigerant, and is a capacity-variable-type compressor. Specifically, it is a hermetic-type compressor wherein a rotary-type, scroll-type, or other volume-type compression element (not shown) housed within a casing (not shown) is driven by a heat source-side compression motor 21*a* housed within the same casing. Inside the casing of the heat source-side compressor 21 is formed a high-pressure space (not shown) in which the heat source-side refrigerant fills after being compressed in the compression element, and refrigerating machine oil is accumulated in this high-pressure space. The heat source-side compression motor 21*a* can vary the rotational speed (i.e., the operating frequency) of the motor 21*a* by an inverter device (not shown), whereby the capacity of the heat source-side compressor 21 can be controlled.

The oil separation mechanism 22 is a mechanism for separating the refrigerating machine oil contained in the heat source-side refrigerant discharged from the heat source-side compressor 21 and returning the oil to the intake of the heat source-side compressor. The oil separation mechanism 22 has primarily an oil separator 22*a* provided to a heat source-side discharge tube 21*b* of the heat source-side compressor 21, and an oil return tube 22*b* for connecting the oil separator 22*a* and a heat source-side intake tube 21*c* of the heat source-side compressor 21. The oil separator 22*a* is a device for separating the refrigerating machine oil contained in the heat source-side refrigerant discharged from the heat source-side compressor 21. The oil return tube 22*b* has a capillary tube. The oil return tube 22*b* is a refrigerant tube for returning the refrigerating machine oil separated from the heat source-side refrigerant in the oil separator 22*a* to the heat source-side intake tube 21*c* of the heat source-side compressor 21.

The heat source-side switching mechanism 23 is a four-way switching valve capable of switching between a heat source-side heat-radiating operation state in which the heat source-side heat exchanger 24 is made to function as a radiator of the heat source-side refrigerant, and a heat source-side evaporating operation state in which the heat source-side heat exchanger 24 is made to function as an evaporator of the heat source-side refrigerant. The heat source-side switching mechanism 23 is connected to the heat source-side discharge tube 21*b*, the heat source-side intake tube 21*c*, a first heat source-side gas refrigerant tube 23*a* connected to the gas side of the heat source-side heat exchanger 24, and a second heat source-side gas refrigerant tube 23*b* connected to the gas-side shut-off valve 30. The heat source-side switching mechanism 23 is capable of switching between an action of which the heat source-side discharge tube 21*b* communicates with the first heat source-side gas refrigerant tube 23*a* and the second heat source-side gas refrigerant tube 23*b* communicates with the heat source-side intake tube 21*c* (equivalent to the heat source-side heat-radiating state, refer to the solid lines of the heat source-side switching mechanism 23 in FIG. 1), and another action of which the heat source-side discharge tube 21*b* communicates with the second heat source-side gas refrigerant tube 23*b* and the first heat source-side gas refrigerant tube 23*a* communicates with the heat source-side intake tube 21*c* (equivalent to the heat source-side evaporating operation state, refer to the dashed lines of the heat source-side switching mechanism 23 in FIG. 1).

The heat source-side switching mechanism 23 is not limited to a four-way switching valve, and may be configured so as to have a function for switching the flow direction of the same heat source-side refrigerant as is described above by combining a plurality of electromagnetic valves, for example.

The heat source-side heat exchanger 24 is a heat exchanger which functions as a radiator or an evaporator of the heat source-side refrigerant by performing heat exchange between the heat source-side refrigerant and outdoor air. A heat source-side liquid refrigerant tube 24*a* is connected to the liquid side of the heat source-side heat exchanger 24, and the first heat source-side gas refrigerant tube 23*a* is connected to the gas side of the heat source-side heat exchanger 24. The outdoor air that undergoes heat exchange with the heat source-side refrigerant in the heat source-side heat exchanger 24 is supplied by a heat source-side fan 32 driven by a heat source-side fan motor 32*a*.

The heat source-side expansion valve 25 is an electric expansion valve for depressurizing or otherwise treating the heat source-side refrigerant flowing through the heat source-side heat exchanger 24, and is provided to the heat source-side liquid refrigerant tube 24*a*.

The intake return tube 26 is a refrigerant tube for branching off some of the heat source-side refrigerant flowing through the heat source-side liquid refrigerant tube 24*a* and returning the refrigerant to the intake of the heat source-side compressor 21. One end of the intake return tube 26 is connected to the heat source-side liquid refrigerant tube 24*a*, and the other end of the tube 26 is connected to the heat source-side intake tube 21*c*. An intake return expansion valve 26*a* whose opening degree can be controlled is provided to the intake return tube 26. The intake return expansion valve 26*a* is configured from an electric expansion valve.

The supercooler 27 is a heat exchanger that performs heat exchange between the heat source-side refrigerant flowing through the heat source-side liquid refrigerant tube 24*a* and the heat source-side refrigerant flowing through the intake return tube 26 (more specifically, the refrigerant that has been depressurized by the intake return expansion valve 26*a*).

The heat source-side accumulator 28 is provided to the heat source-side intake tube 21*c*, and is a container for primarily accumulating the heat source-side refrigerant circulating through the heat source-side refrigerant circuit 20 before the refrigerant is drawn from the heat source-side intake tube 21*c* into the heat source-side compressor 21.

The liquid-side shut-off valve 29 is a valve provided to the connecting portion between the heat source-side liquid refrigerant tube 24*a* and the liquid refrigerant communication tube 13. The gas-side shut-off valve 30 is a valve provided to the connecting portion between the second heat source-side gas refrigerant tube 23*b* and the gas refrigerant communication tube 14.

Various sensors are provided to the heat source unit 2. Specifically, the heat source unit is provided with a heat source-side intake pressure sensor 33, a heat source-side discharge pressure sensor 34, a heat source-side heat exchange temperature sensor 35, and an outdoor air temperature sensor 36. The heat source-side intake pressure sensor 33 detects the heat source-side intake pressure Ps, which is the pressure of the heat source-side refrigerant being drawn into the heat source-side compressor 21. The heat source-side discharge pressure sensor 34 detects the heat source-side discharge pressure Pd, which is the pressure of the heat source-side refrigerant being discharged from the heat source-side compressor 21. The heat source-side heat exchange temperature sensor 35 detects the heat source-side heat exchanger temperature Thx, which is the temperature of the heat source-side refrigerant in the liquid side of the heat source-side heat exchanger 24. The outdoor air temperature sensor 36 detects the outdoor air temperature To.

—Liquid Refrigerant Communication Tube—

The liquid refrigerant communication tube 13 is connected to the heat source-side liquid refrigerant tube 24*a* via the liquid-side shut-off valve 29. The liquid refrigerant communication tube 13 is a refrigerant tube capable of leading the heat source-side refrigerant out of the heat source unit 2 through the outlet of the heat source-side heat exchanger 24 functioning as a radiator of the heat source-side refrigerant when the heat source-side switching mechanism 23 is in the heat source-side heat-radiating operation state. The liquid refrigerant communication tube 13 is a refrigerant tube capable of leading the heat source-side refrigerant from the exterior of the heat source unit 2 into the inlet of the heat source-side heat exchanger 24 functioning as an evaporator of the heat source-side refrigerant when the heat source-side switching mechanism 23 is in the heat source-side evaporating operation state.

—Gas Refrigerant Communication Tube—

The gas refrigerant communication tube 14 is connected to the second heat source-side gas refrigerant tube 23*b* via the gas-side shut-off valve 30. The gas refrigerant communication tube 14 is a refrigerant tube capable of leading the heat source-side refrigerant into the intake side of the heat source-side compressor 21 from the exterior of the heat source unit 2 when the heat source-side switching mechanism 23 is in the heat source-side heat-radiating operation state. The gas refrigerant communication tube 14 is also a refrigerant tube capable of leading the heat source-side refrigerant out of the heat source unit 2 through the discharge side of the heat source-side compressor 21 when the heat source-side switching mechanism 23 is in the heat source-side evaporating operation state.

—Usage-Side Unit—

The usage-side unit 4 is installed indoors. The usage-side unit 4 is connected to the heat source unit 2 via the liquid refrigerant communication tube 13 and the gas refrigerant communication tube 14, constituting part of the heat source-side refrigerant circuit 20. The usage-side refrigerant circuit 40 is also configured within the usage-side unit 4. Furthermore, the usage-side unit 4 is connected to the hot-water storage unit 8 and the warm-water heating unit 9 via the aqueous medium communication tubes 15, 16, constituting part of the aqueous medium circuit 80.

The usage-side unit 4 principally comprises a usage-side heat exchanger 41, a usage-side flow rate adjustment valve 42, the usage-side compressor 62, the refrigerant-water heat exchanger 65, a refrigerant-water heat-exchange-side flow rate adjustment valve 66, a usage-side accumulator 67, and a circulation pump 43.

The usage-side heat exchanger 41 performs heat exchange between the heat source-side refrigerant and the usage-side refrigerant. Specifically, the usage-side heat exchanger 41 is a heat exchanger that can function as a radiator of the heat source-side refrigerant and also as an evaporator of the usage-side refrigerant during the hot-water supply operation. Within the usage-side heat exchanger 41, a usage-side liquid refrigerant tube 45 is connected to the liquid side of the flow passage through which the heat source-side refrigerant flows, and a usage-side gas refrigerant tube 54 is connected to the gas side of the flow passage through which the heat source-side refrigerant flows. Also within the usage-side heat exchanger 41, a cascade-side liquid refrigerant tube 68 is connected to the liquid side of the flow channel through which the usage-side refrigerant flows, and a second cascade-side gas refrigerant tube 69 is connected to the gas side of the flow passage through which the usage-side refrigerant flows. The liquid refrigerant communication tube 13 is connected to the usage-side liquid refrigerant tube 45, and the gas refrigerant communication tube 14 is connected to the usage-side gas refrigerant tube 54. The refrigerant-water heat exchanger 65 is connected to the cascade-side liquid refrigerant tube 68, and the usage-side compressor 62 is connected to the second cascade-side gas refrigerant tube 69.

The usage-side flow rate adjustment valve 42 is an electric expansion valve capable of varying the flow rate of heat source-side refrigerant flowing through the usage-side heat exchanger 41 by adjusting the opening degree of the adjustment valve 42. The usage-side flow rate adjustment valve 42 is connected to the usage-side liquid refrigerant tube 45.

The usage-side compressor 62 is a mechanism for compressing the usage-side refrigerant, and is a capacity-variable-type compressor. Specifically, the usage-side compressor 62 is a hermetic-type compressor wherein a rotary-type, scroll-type, or other volume-type compression element (not shown) housed within a casing (not shown) is driven by a usage-side compressor motor 63 housed within the same casing. Inside the casing of the usage-side compressor 62 is formed a high-pressure space (not shown) in which the usage-side refrigerant fills after being compressed in the compression element, and refrigerating machine oil is accumulated in this high-pressure space. The usage-side compressor motor 63 can vary the rotational speed (i.e., the operating frequency) of the motor 63 using an inverter device (not shown), whereby the capacity of usage-side compressor 62 can be controlled. A cascade-side discharge tube 70 is connected to the discharge side of the usage-side compressor 62, and a cascade-side intake tube 71 is connected to the intake side of the usage-side compressor 62. This cascade-side intake tube 71 is connected to the second cascade-side gas refrigerant tube 69.

The refrigerant-water heat exchanger 65 is a device for performing heat exchange between the usage-side refrigerant and the aqueous medium. Specifically, the refrigerant-water heat exchanger 65 can heat the aqueous medium during the hot-water supply operation by functioning as a radiator of the usage-side refrigerant. Within the refrigerant-water heat exchanger 65, the cascade-side liquid refrigerant tube 68 is connected to the liquid side of the flow passage through which the usage-side refrigerant flows, and a first cascade-side gas refrigerant tube 72 is connected to the gas side of the flow passage through which the usage-side refrigerant flows. Also within the refrigerant-water heat exchanger 65, a first usage-side water inlet tube 47 is connected to the inlet side of the flow passage through which the aqueous medium flows, and a first usage-side water outlet tube 48 is connected to the outlet side of the flow passage through which the aqueous medium flows. The first cascade-side gas refrigerant tube 72 is connected to the cascade-side discharge tube 70. The aqueous medium communication tube 15 is connected to the first usage-side water inlet tube 47, and the aqueous medium communication tube 16 is connected to the first usage-side water outlet tube 48.

The refrigerant-water heat-exchange side flow rate adjustment valve 66 is an electric expansion valve capable of varying the flow rate of usage-side refrigerant flowing through the refrigerant-water heat exchanger 65 by adjusting the opening degree of the adjustment valve 66 itself. The refrigerant-water heat-exchange side flow rate adjustment valve 66 is connected to the cascade-side liquid refrigerant tube 68.

The usage-side accumulator 67 is provided to the cascade-side intake tube 71. The usage-side accumulator 67 is a container for accumulating once the usage-side refrigerant circulating through the usage-side refrigerant circuit 40 before the refrigerant is drawn into the usage-side compressor 62 from the cascade-side intake tube 71.

The circulation pump 43 is a mechanism for increasing the pressure of the aqueous medium and is provided to the first usage-side water outlet tube 48. Specifically, a pump in which a centrifugal or volume-type pump element (not shown) is driven by a circulation pump motor 44 is used as the circulation pump 43. The rotational speed (i.e., the operation frequency) of the circulation pump motor 44 can be varied using an in device (not shown), whereby the capacity of the circulation pump 43 can be controlled.

With the configuration described above, the usage-side unit 4 performs the hot-water supply operation for heating the aqueous medium. Specifically, when the usage-side heat exchanger 41 is made to function as a radiator of the heat source-side refrigerant led in from the gas refrigerant communication tube 14, the heat source-side refrigerant whose heat has been radiated in the usage-side heat exchanger 41 is led out to the liquid refrigerant communication tube 13. The usage-side refrigerant circulating through the usage-side refrigerant circuit 40 is heated by the heat radiation of the heat source-side refrigerant in the usage-side heat exchanger 41. After this heated usage-side refrigerant has been compressed in the usage-side compressor 62, the refrigerant radiates heat in the refrigerant-water heat exchanger 65, whereby the aqueous medium is heated.

Various sensors are provided to the usage-side unit 4. Specifically, the usage-side unit 4 is provided with a usage-side heat exchange temperature sensor 50, a refrigerant-water heat exchange temperature sensor 73, an aqueous medium inlet temperature sensor 51, an aqueous medium outlet temperature sensor 52, a usage-side intake pressure sensor 74, a usage-side discharge pressure sensor 75, and a usage-side discharge temperature sensor 76. The usage-side heat exchange temperature sensor 50 detects the usage-side refrigerant temperature Tsc1, which is the temperature of the heat source-side refrigerant in the liquid side of the usage-side heat exchanger 41. The refrigerant-water heat exchange temperature sensor 73 detects the cascade-side refrigerant temperature Tsc2, which is the temperature of the usage-side refrigerant in the liquid side of the refrigerant-water heat exchanger 65. The aqueous medium inlet temperature sensor 51 detects the aqueous medium inlet temperature Twr, which is the temperature of the aqueous medium in the inlet of the refrigerant-water heat exchanger 65. The aqueous medium outlet temperature sensor 52 detects the aqueous medium outlet temperature Tw1, which is the temperature of the aqueous medium in the outlet of the refrigerant-water heat exchanger 65. The usage-side intake pressure sensor 74 detects the usage-side intake pressure Ps2, which is the pressure of the usage-side refrigerant being drawn into the usage-side compressor 62. The usage-side discharge pressure sensor 75 detects the usage-side discharge pressure Pd2, which is the pressure of the usage-side refrigerant being discharged from the usage-side compressor 62. The usage-side discharge temperature sensor 76 detects the usage-side discharge temperature Td2, which is the temperature of the usage-side refrigerant being discharged from the usage-side compressor 62.

—Hot-Water Storage Unit—

The hot-water storage unit 8 is an aqueous medium device which uses the aqueous medium supplied from the usage-side unit 4, and is installed indoors. The hot-water storage unit 8 is connected to the usage-side unit 4 via the aqueous medium communication tubes 15, 16, constituting part of the aqueous medium circuit 80.

The hot-water storage unit 8 has primarily a hot-water storage tank 81 and a heat exchange coil 82.

The hot-water storage tank 81 is a container for accumulating water as the aqueous medium supplied for the hot water supply. Connected to the top portion of the hot-water storage tank 81 is a hot-water supply tube 83 for feeding the aqueous medium that has been heated for a faucet, a shower, or the like, and connected to the bottom portion is a water supply tube 84 for replenishing the aqueous medium that has been consumed by the hot-water supply tube 83.

The heat exchange coil 82 is provided inside the hot-water storage tank 81. The heat exchange coil 82 is a heat exchanger which functions as a heater of the aqueous medium in the hot-water storage tank 81 by performing heat exchange between the aqueous medium circulating through the aqueous medium circuit 80 and the aqueous medium in the hot-water storage tank 81. The aqueous medium communication tube 16 is connected to the inlet of the heat exchange coil 82, and the aqueous medium communication tube 15 is connected to the outlet of the heat exchange coil 82.

The hot-water storage unit 8 is thereby capable of heating the aqueous medium in the hot-water storage tank 81 and accumulating the aqueous medium as warm water by the aqueous medium heated in the usage-side unit 4 and circulating through the aqueous medium circuit 80 during the hot-water supply operation. The type of hot-water storage unit used as the hot-water storage unit 8 is one that accumulates in a hot-water storage tank the aqueous medium heated by heat exchange with the aqueous medium heated in the usage-side unit 4, but another type that also may be used is a hot-water storage unit that accumulates in a hot-water storage tank the aqueous medium heated in the usage-side unit 4.

Various sensors are provided to the hot-water storage unit 8. Specifically, the hot-water storage unit 8 is provided with a hot-water storage temperature sensor 85 for detecting the hot-water storage temperature Twh, which is the temperature of the aqueous medium accumulated in the hot-water storage tank 81.

—Warm-Water Heating Unit—

The warm-water heating unit 9 is an aqueous medium device that uses the aqueous medium supplied from the usage-side unit 4, and is installed indoors. The warm-water heating unit 9 is connected to the usage-side unit 4 via the aqueous medium communication tubes 15, 16, constituting part of the aqueous medium circuit 80.

The warm-water heating unit 9 primarily has a heat exchange panel 91 and constitutes a radiator, a floor heating panel, or the like.

When the heat exchange panel 91 constitutes a radiator, it is provided alongside a wall in a room, for example, and when the heat exchange panel 91 constitutes a floor heating panel, it is provided under the floor in a room, for example. The heat exchange panel 91 is a heat exchanger which functions as a radiator of the aqueous medium circulating through the aqueous medium circuit 80. The aqueous medium communication tube 16 is connected to the inlet of the heat exchange panel 91, and the aqueous medium communication tube 15 is connected to the outlet of the heat exchange panel 91.

—Aqueous Medium Communication Tubes—

The aqueous medium communication tube 15 is connected to the outlet of the heat exchange coil 82 of the hot-water storage unit 8 and to the outlet of the heat exchange panel 91 of the warm-water heating unit 9. The aqueous medium communication tube 16 is connected to the inlet of the heat exchange coil 82 of the hot-water storage unit 8 and to the inlet of the heat exchange panel 91 of the warm-water heating unit 9. The aqueous medium communication tube 16 is provided with an aqueous medium-side switching mechanism 161 capable of switching between supplying the aqueous medium circulating through the aqueous medium circuit 80 to both the hot-water storage unit 8 and the warm-water heating unit 9, and supplying the aqueous medium either one of the hot-water storage unit 8 and the warm-water heating unit 9. This aqueous medium-side switching mechanism 161 is configured from a three-way valve.

—Usage-Side Correspondence Unit—

Figure 2:
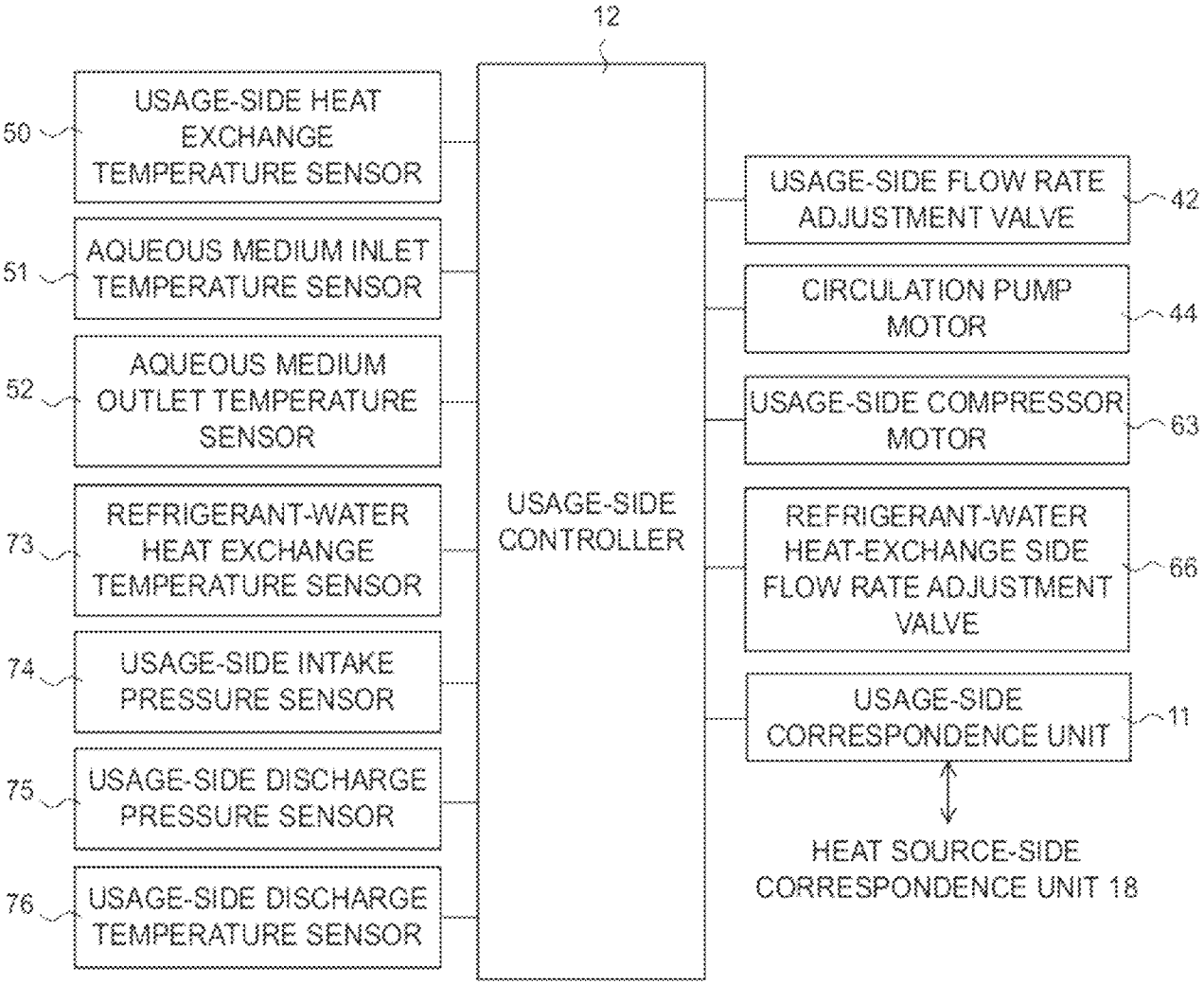
FIG. 2 is a diagram schematically depicting the usage-side controller according to the present embodiment and the various sensors and various devices connected to this controller.

The usage-side correspondence unit 11 is electrically connected to the usage-side controller 12 and is provided inside the usage-side unit 4, as shown in FIGS. 1 and 2. The usage-side correspondence unit 11 is electrically connected to the heat source-side correspondence unit 18 (described hereinafter) provided inside the heat source unit 2. The usage-side correspondence unit 11 can receive various items of information and data pertaining to the operating state and control of the heat pump system 1 from the heat source-side correspondence unit 18, and the usage-side correspondence unit 11 can also transmit information and data to the heat source-side correspondence unit 18.

Particularly, the usage-side correspondence unit 11 according to the present embodiment can transmit information pertaining to the operating capacity control of the usage-side compressor 62 of the usage-side unit 4 to the heat source-side correspondence unit 18.

—Usage-Side Controller—

The usage-side controller 12 is a microcomputer composed of a CPU, memory, and the like; and is provided inside the usage-side unit 4. The usage-side controller 12 is connected with the usage-side flow rate adjustment valve 42, the circulation pump motor 44, the usage-side compressor motor 63, the refrigerant-water heat-exchange side flow rate adjustment valve 66, and the various sensors 50 to 52 and 73 to 76 of the usage-side unit 4, as shown in FIG. 2. The usage-side controller 12 controls the various connected devices on the basis of the detection results of the various sensors 50 to 52 and 73 to 76, for example. Specifically, the usage-side controller 12 performs flow rate control on the heat source-side refrigerant by controlling the opening degree of the usage-side flow rate adjustment valve 42, capacity control on the circulation pump 43 by controlling the rotational speed of the circulation pump motor 44, operating capacity control on the usage-side compressor 62 by controlling the rotational speed (i.e. controlling the operating frequency) of the usage-side compressor motor 63, and flow rate control on the usage-side refrigerant by adjusting the opening degree of the refrigerant-water heat-exchange side flow rate adjustment valve 66. For example, the usage-side controller 12 performs opening degree control on the flow rate adjustment valves 42, 66 so that the supercooling degrees of the refrigerants become constant, in order to stabilize both the flow rate of the heat source-side refrigerant in the heat source-side refrigerant circuit 20 and the flow rate of the usage-side refrigerant in the usage-side refrigerant circuit 40. The usage-side controller 12 also performs capacity control on the circulation pump 43 so that the temperature difference between the outlet temperature and the inlet temperature of the aqueous medium in the refrigerant-water heat exchanger 65 reaches a predetermined temperature difference, in order to bring the flow rate of the aqueous medium in the aqueous medium circuit 80 to an appropriate flow rate.

Particularly, the usage-side controller 12 according to the present embodiment performs a control for enabling the usage-side unit 4 to supply an aqueous medium of an appropriate temperature to the hot-water storage unit 8 and the warm-water heating unit 9, as well as incremental variable control on the operating capacity of the usage-side compressor 62. These types of control are described in detail under "—Condensation Temperature Control of Refrigerant Circuits—" in the <Action> section.

—Heat Source-Side Correspondence Unit—

Figure 3:
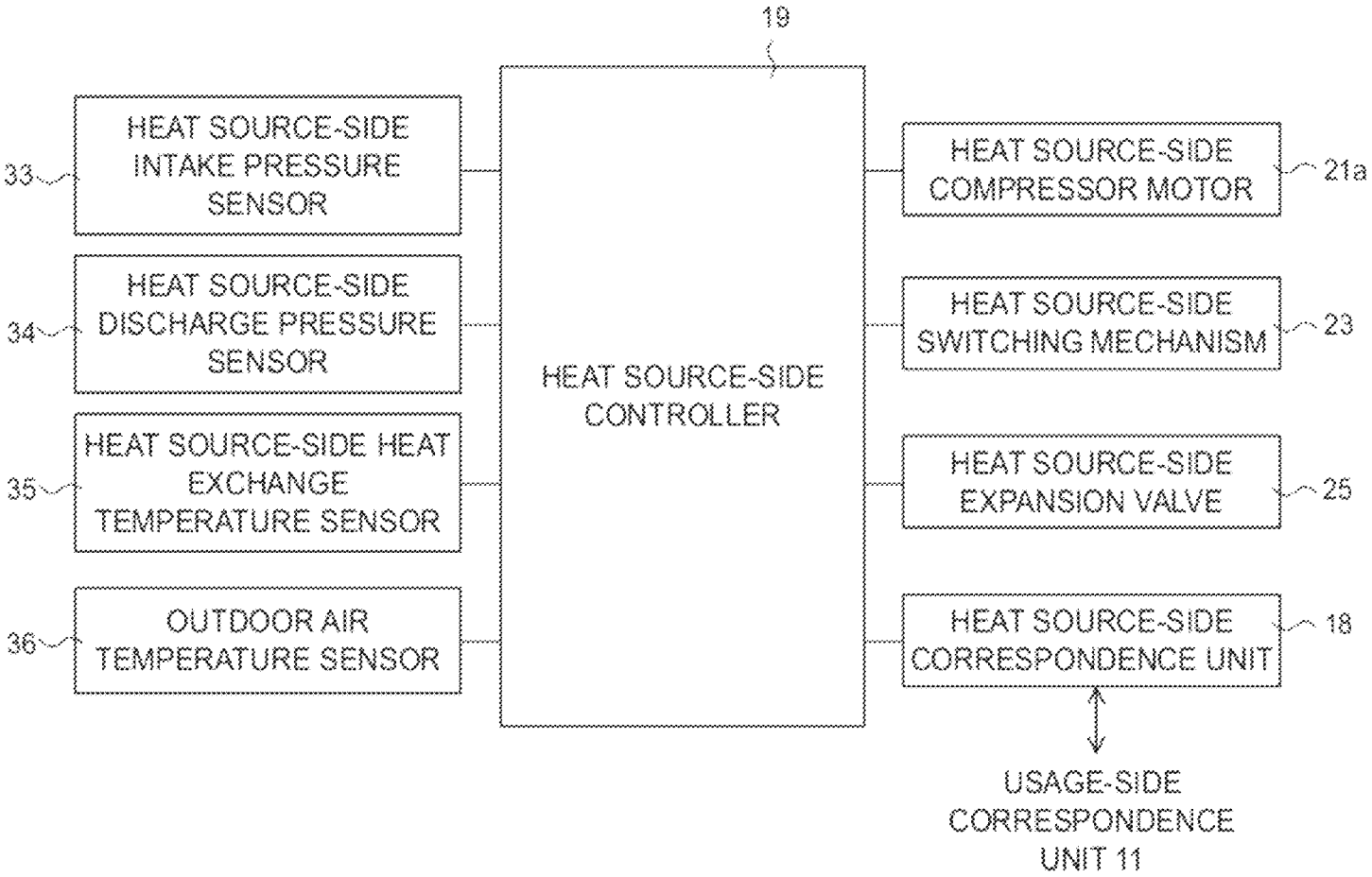
FIG. 3 is a diagram schematically depicting the heat source-side controller according to the present embodiment and the various sensors and various devices connected to this controller.

The heat source-side correspondence unit 18 is electrically connected to the heat source-side controller 19 and is provided inside the heat source unit 2, as shown in FIGS. 1 and 3. The heat source-side correspondence unit 18 is electrically connected with the usage-side correspondence unit 11. The heat source-side correspondence unit 18 can receive various items of information, data, and the like pertaining to the operating state and control of the heat pump system 1 from the usage-side correspondence unit 11, and the heat source-side correspondence unit 18 can also transmit information and data to the usage-side correspondence unit 11.

Particularly, the heat source-side correspondence unit 18 according to the present embodiment can receive information pertaining to the operating capacity control of the usage-side compressor 62 of the usage-side unit 4 from the usage-side correspondence unit 11.

—Heat Source-Side Controller—

The heat source-side controller 19 is a microcomputer composed of a CPU, memory, and the like, and is provided inside the heat source unit 2. The heat source-side controller 19 is connected with the heat source-side compressor motor 21*a*, the heat source-side switching mechanism 23, the heat source-side expansion valve 25, and the various sensors 33 to 36 of the heat source unit 2, as shown in FIG. 3. The heat source-side controller 19 controls the various connected devices on the basis of the detection results of the various sensor 33 to 36, for example. Specifically, the heat source-side controller 19 performs operating capacity control on the heat source-side compressor 21 by controlling the rotational speed (i.e. controlling the operating frequency) of the heat source-side compressor motor 21*a*, and also performs state switching control on the heat source-side switching mechanism 23 and opening degree control on the heat source-side expansion valve 25.

Particularly, the heat source-side controller 19 according to the present embodiment performs a control for bringing the condensation temperature of the heat source-side refrigerant to a predetermined condensation target temperature, and incremental variable control on the operating capacity of the heat source-side compressor 21. These types of controls are described in detail under "—Condensation Temperature Control of Refrigerant Circuits" in the <Action> section.

—Remote Controller—

Figure 4:
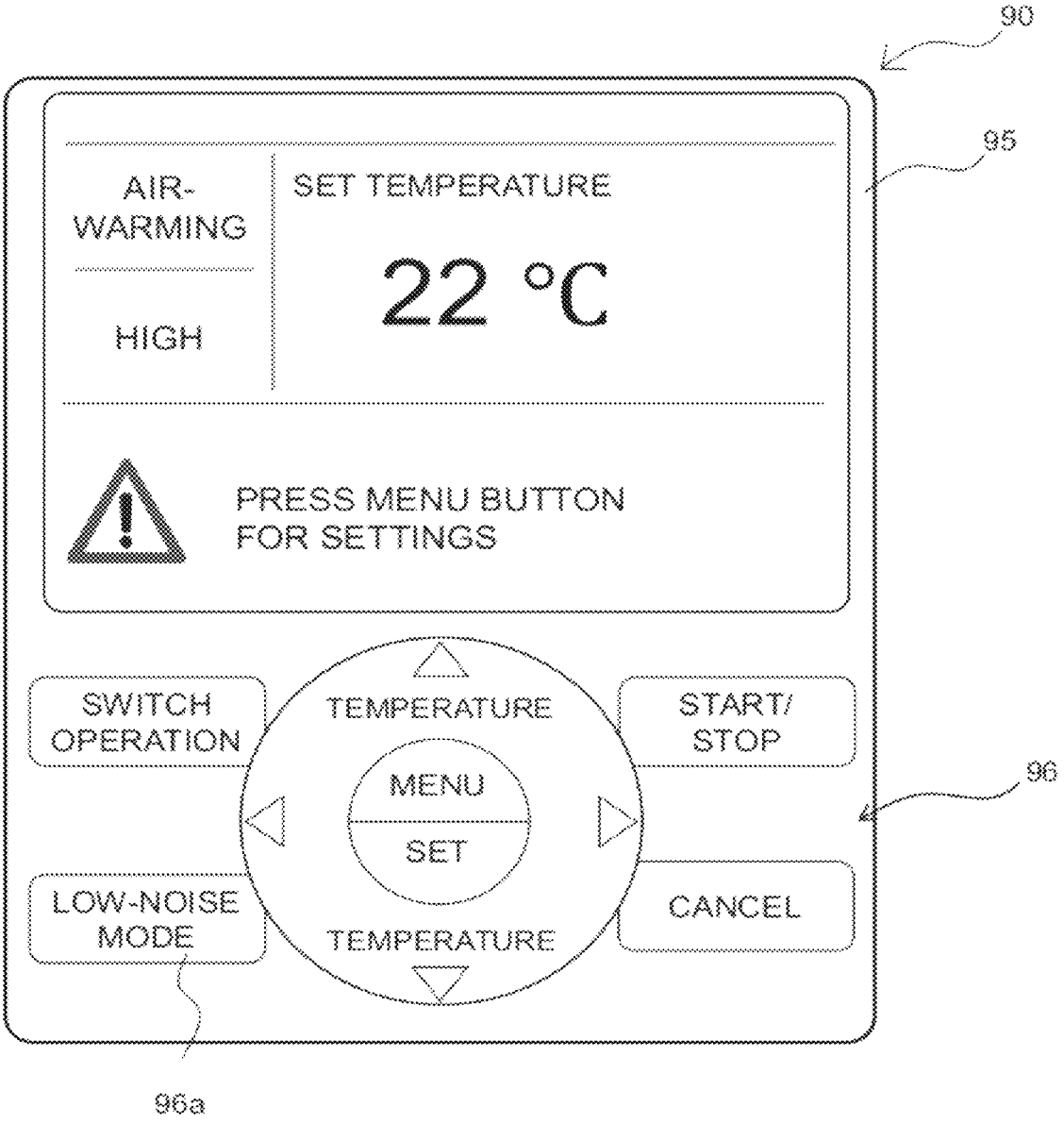
FIG. 4 is an external of the remote controller according to the present embodiment.

The remote controller 90 is installed indoors, and is connected with the usage-side correspondence unit 11 and the heat source-side correspondence unit 18 so as to be capable of correspondence either via wires or wirelessly, as shown in FIG. 1. The remote controller 90 primarily has a display unit 95 and an operating unit 96, as shown in FIG. 4. A user can set the temperature of the aqueous medium of the heat pump system 1 and can issue commands pertaining to various operations via the remote controller 90.

Particularly, a low-noise mode button 96*a* (equivalent to a reception unit) is included in the operating unit 96 relating to the remote controller 90 of the present embodiment. The low-noise mode button 96*a* is a button for receiving a command to reduce the noise made by the operation of the usage-side unit 4. When this low-noise mode button 96*a* is pressed by the user, the operating capacity incremental variable control of the usage-side compressor 62, described hereinafter, can be implemented in the heat pump system 1.

<Action>

Next, the action of the heat pump system 1 will be described.

An example of an operating mode of the heat pump system 1 is the hot-water supply operation mode for performing the hot-water supply operation of the usage-side unit 4 (i.e., the operation of the hot-water storage unit 8 and/or the warm-water heating unit 9).

—Hot-Water Supply Operation Mode—

When the usage-side unit 4 performs the hot-water supply operation, in the heat source-side refrigerant circuit 20, the heat source-side switching mechanism 23 is switched to the heat source-side evaporating operation state (the state shown by the dashed lines of the heat source-side switching mechanism 23 in FIG. 1), and the intake return expansion valve 26*a* is closed. In the aqueous medium circuit 80, the aqueous medium switching mechanism 161 is switched to a state of supplying the aqueous medium to the hot-water storage unit 8 and/or the warm-water heating unit 9.

In the heat source-side refrigerant circuit 20 in such a state, the heat source-side refrigerant of a constant pressure in the refrigeration cycle is drawn through the heat source-side intake tube 21*c* into the heat source-side compressor 21, compressed to a high pressure in the refrigeration cycle, and then discharged to the heat source-side discharge tube 21*b*. The high-pressure heat source-side refrigerant discharged to the heat source-side discharge tube 21*b* has the refrigerating machine oil separated in the oil separator 22*a*. The refrigerating machine oil separated from the heat source-side refrigerant in the oil separator 22*a* is returned to the heat source-side intake tube 21*c* through the oil return tube 22*b*. The high-pressure heat source-side refrigerant from which the refrigerating machine oil has been separated is sent through the heat source-side switching mechanism 23, the second heat source-side gas refrigerant tube 23*b*, and the gas-side shut-off valve 30 to the gas refrigerant communication tube 14 from the heat source unit 2.

The high-pressure heat source-side refrigerant sent to the gas refrigerant communication tube 14 is sent to the usage-side unit 4. The high-pressure heat source-side refrigerant sent to the usage-side unit 4 is sent through the usage-side gas refrigerant tube 54 to the usage-side heat exchanger 41.

The high-pressure heat source-side refrigerant sent to the usage-side heat exchanger 41 radiates heat in the usage-side heat exchanger 41 through heat exchange with the low-pressure usage-side refrigerant in the refrigeration cycle circulating through the usage-side refrigerant circuit 40. Having radiated heat in the usage-side heat exchanger 41, the high-pressure heat source-side refrigerant is sent from the usage-side unit 4 to the liquid refrigerant communication tube 13 through the usage-side flow rate adjustment valve 42 and the usage-side liquid refrigerant tube 45.

The heat source-side refrigerant sent to the liquid refrigerant communication tube 13 is sent to the heat source unit 2. The heat source-side refrigerant sent to the heat source unit 2 is sent through the liquid-side shut-off valve 29 to the supercooler 27. The heat source-side refrigerant sent to the supercooler 27 is sent to the heat source-side expansion valve 25 without undergoing heat exchange because heat source-side refrigerant does not flow to the intake return tube 26. The heat source-side refrigerant sent to the heat source-side expansion valve 25 is depressurized in the heat source-side expansion valve 25 into a low-pressure gas-liquid two-phase state, and is then sent through the heat source-side liquid refrigerant tube 24*a* to the heat source-side heat exchanger 24. The low-pressure refrigerant sent to the heat source-side heat exchanger 24 is evaporated in the heat source-side heat exchanger 24 by heat exchange with outdoor air supplied by the heat source-side fan 32. The low-pressure heat source-side refrigerant evaporated in the heat source-side heat exchanger 24 is sent through the first heat source-side gas refrigerant tube 23*a* and the heat source-side switching mechanism 23 to the heat source-side accumulator 28. The low-pressure heat source-side refrigerant sent to the heat source-side accumulator 28 is again drawn into the heat source-side compressor 21 through the heat source-side intake tube 21*c*.

In the usage-side refrigerant circuit 40, the low-pressure usage-side refrigerant in the refrigeration cycle circulating through the usage-side refrigerant circuit 40 is heated and evaporated by the heat radiation of the heat source-side refrigerant in the usage-side heat exchanger 41. The low-pressure usage-side refrigerant evaporated in the usage-side heat exchanger 41 is sent through the second cascade-side gas refrigerant tube 69 to the usage-side accumulator 67. The low-pressure usage-side refrigerant sent to the usage-side accumulator 67 is drawn into the usage-side compressor 62 through the cascade-side intake tube 71, compressed to a high pressure in the refrigeration cycle, and discharged to the cascade-side discharge tube 70. The high-pressure usage-side refrigerant discharged to the cascade-side discharge tube 70 is sent through the first cascade-side gas refrigerant tube 72 to the refrigerant-water heat exchanger 65. The high-pressure usage-side refrigerant sent to the refrigerant-water heat exchanger 65 radiates heat in the refrigerant-water heat exchanger 65 through heat exchange with the aqueous medium being circulated through the aqueous medium circuit 80 by the circulation pump 43. Having radiated heat in the refrigerant-water heat exchanger 65, the high-pressure usage-side refrigerant is depressurized in the refrigerant-water heat-exchange side flow rate adjustment valve 66 to a low-pressure gas-liquid two-phase state, and is again sent through the cascade-side liquid refrigerant tube 68 to the usage-side heat exchanger 41.

In the aqueous medium circuit 80, the aqueous medium circulating through the aqueous medium circuit 80 is heated by the heat radiation of the usage-side refrigerant in the refrigerant-water heat exchanger 65. The aqueous medium heated in the refrigerant-water heat exchanger 65 is drawn into the circulation pump 43 through the first usage-side water outlet tube 48 and increased in pressure, and is then sent from the usage-side unit 4 through the aqueous medium communication tube 16 and the aqueous medium switching mechanism 161 to the hot-water storage unit 8 and/or the warm-water heating unit 9. The aqueous medium sent to the hot-water storage unit 8 radiates heat in the heat exchange coil 82 through heat exchange with the aqueous medium in the hot-water storage tank 81, and the aqueous medium in the hot-water storage tank 81 is thereby heated. The aqueous medium sent to the warm-water heating unit 9 radiates heat in the heat exchange panel 91, and the wall in the room or floor in the room is thereby heated.

Thus is performed the action in the hot-water supply operation mode fir performing the hot-water supply operation of the usage-side unit 4.

—Condensation Temperature Control of Refrigerant Circuits—

—Control For Bringing Condensation Temperature to Predetermined Condensation Target Temperature—

The following is a description of condensation temperature control of each of the refrigerant circuits 20, 40 during the hot-water supply operation described above.

With this heat pump system 1, the usage-side refrigerant circulating through the usage-side refrigerant circuit 40 is heated in the usage-side heat exchanger 41 by the heat radiation of the heat source-side refrigerant circulating through the heat source-side refrigerant circuit 20 as described above. In the usage-side refrigerant circuit 40, this heat obtained from the heat source-side refrigerant can be used to obtain a refrigeration cycle of a higher temperature than the refrigeration cycle in the heat source-side refrigerant circuit 20, and a high-temperature aqueous medium can therefore be obtained by the heat radiation of the usage-side refrigerant in the refrigerant-water heat exchanger 65. At this time, to obtain a high-temperature aqueous medium in a stable manner, the refrigeration cycle in the heat source-side refrigerant circuit 20 and the refrigeration cycle in the usage-side refrigerant circuit 40 are preferably controlled so that they both stabilize.

In view of this, the heat source-side controller 19 is designed to control the operating capacity of the capacity-variable-type heat source-side compressor 21 during the hot-water supply operation so that the condensation temperature Tc1 of the heat source-side refrigerant in the usage-side heat exchanger 41 functioning as a condenser (i.e. radiator) of the heat source-side refrigerant reaches a predetermined heat source-side condensation target temperature Tc1s. The usage-side controller 12 is designed to control the operating capacity of the capacity-variable-type usage-side compressor 62 so that the condensation temperature Tc2 of the usage-side refrigerant in the refrigerant-water heat exchanger 65 functioning as a condenser (i.e. radiator) of the usage-side refrigerant reaches a predetermined usage-side condensation target temperature Tc2s.

The condensation temperature Tc1 of the heat source-side refrigerant is equivalent to a value obtained by converting the heat source-side discharge pressure Pd1, which is the pressure of the heat source-side refrigerant being discharged from the heat source-side compressor 21, to a saturation temperature equivalent to this pressure value (i.e., a heat source-side discharge saturation temperature). The condensation temperature Tc2 of the usage-side refrigerant is equivalent to a value obtained by converting the usage-side discharge pressure Pd2, which is the pressure of the usage-side refrigerant being discharged from the usage-side compressor 62, to a saturation temperature equivalent to this pressure value (i.e., a usage-side discharge saturation temperature).

In the heat source-side refrigerant circuit 20, when the condensation temperature Tc1 of the heat source-side refrigerant is less than the predetermined heat source-side condensation target temperature Tc1s (Tc1<Tc1s), the heat source-side controller 19 performs a control so that the operating capacity of the heat source-side compressor 21 increases by increasing the rotational speed (i.e. the operating frequency) of the heat source-side compressor 21. Conversely, when the condensation temperature Tc1 of the heat source-side refrigerant is greater than the predetermined heat source-side condensation target temperature Tc1s (Tc1>Tc1s), the heat source-side controller 19 performs a control so that the operating capacity of the heat source-side compressor 21 decreases by reducing the rotational speed (i.e. the operating frequency) of the heat source-side compressor 21. In the usage-side refrigerant circuit 40, when the condensation temperature Tc2 of the usage-side refrigerant is less than the predetermined usage-side condensation target temperature Tc2s (Tc2<Tc2s), the usage-side controller 12 performs a control so that the operating capacity of the usage-side compressor 62 increases by increasing the rotational speed (i.e. the operating frequency) of the usage-side compressor 62. Conversely, when the condensation temperature Tc2 of the usage-side refrigerant is greater than the predetermined usage-side condensation target temperature Tc2s (Tc2>Tc2s), the usage-side controller 12 performs a control so that the operating capacity of the usage-side compressor 62 decreases by reducing the rotational speed (i.e. the operating frequency) of the usage-side compressor 62.

The pressure of the heat source-side refrigerant flowing within the usage-side heat exchanger 41 thereby stabilizes in the heat source-side refrigerant circuit 20. In the usage-side refrigerant circuit 40, the pressure of the usage-side refrigerant flowing within the refrigerant-water heat exchanger 65 also stabilizes. Therefore, the states of the refrigeration cycles in both refrigerant circuits 20, 40 can be stabilized, and a high-temperature aqueous medium can be obtained in a stable manner.

During the hot-water supply operation, the aforementioned heat source-side condensation target temperature Tc1s and usage-side condensation target temperature Tc2s are preferably set appropriately by the heat source-side controller 19 and the usage-side controller 12 in order to obtain an aqueous medium of the predetermined temperature.

In view of this, first, for the usage-side refrigerant circuit 40, the usage-side controller 12 sets a predetermined target aqueous medium outlet temperature Tw1s, which is the target value of the temperature of the aqueous medium in the outlet of the refrigerant-water heat exchanger 65, and sets the usage-side condensation target temperature Tc2s as a value that can be varied by the target aqueous medium outlet temperature Tw1s. For example, when the target aqueous medium outlet temperature Tw1s is set to 80° C., the usage-side condensation target temperature Tc2s is set to 85° C. When the target aqueous medium outlet temperature Tw1s is set to 25° C., the usage-side condensation target temperature Tc2s is set to 30° C. In other words, the usage-side condensation target temperature Tc2s is set high along with the target aqueous medium outlet temperature Tw1s being set high, and is set by a function within a range of 30° C. to 85° C. so as to be a temperature slightly higher than the target aqueous medium outlet temperature Tw1s. The usage-side condensation target temperature Tc2s is thereby appropriately set according to the target aqueous medium outlet temperature Tw1s, and it is therefore easy to obtain the desired target aqueous medium outlet temperature Tw1s. Highly responsive control is performed even when the target aqueous medium outlet temperature Tw1s has been changed.

For the heat source-side refrigerant circuit 20, the heat source-side controller 19 sets the heat source-side condensation target temperature Tc1s as a value that can be varied by the usage-side condensation target temperature Tc2s or the target aqueous medium outlet temperature Tw1s. For example, when the usage-side condensation target temperature Tc2s or the target aqueous medium outlet temperature Tw1s is set to 75° C. or 80° C., the heat source-side controller 19 sets the heat source-side condensation target temperature Tc1s to a temperature range of 35° C. to 40° C. When the usage-side condensation target temperature Tc2s or the target aqueous medium outlet temperature Tw1s is set to 30° C. or 25° C., the heat source-side controller 19 sets the heat source-side condensation target temperature Tc1s to a temperature range of 10° C. to 15° C. In other words, the heat source-side controller 19 sets the heat source-side condensation target temperature Tc1s to also be in a high temperature range along with the setting of the usage-side condensation target temperature Tc2s or the target aqueous medium outlet temperature Tw1s to a high temperature, and sets the heat source-side condensation target temperature Tc1s by a function to a range of 10° C. to 40° C. so that the temperature Tc1s is in a lower temperature range than the usage-side condensation target temperature Tc2s or the target aqueous medium outlet temperature Tw1s.

The usage-side condensation target temperature Tc2s is preferably set as one temperature as described above for the object of reliably obtaining the target aqueous medium outlet temperature Tw1s. However, the heat source-side condensation target temperature Tc1s does not need to be set as strictly as the usage-side condensation target temperature Tc2s, and is set as the "temperature range" in the above description because it is rather preferable to allow a temperature range of a certain extent. The heat source-side condensation target temperature Tc1s is thereby appropriately set according to the usage-side condensation target temperature Tc2s or the target aqueous medium outlet temperature Tw1s, and the refrigeration cycle in the heat source-side refrigerant circuit 20 is appropriately controlled according to the state of the refrigeration cycle in the usage-side refrigerant circuit 40.

—Incremental Variable Control of Operating Capacity—

Furthermore, in this heat pump system 1, the heat source-side compressor 21 and the usage-side compressor 62 are both configured to be variable in capacity, as has already been described. Therefore, when the operating capacities of the heat source-side compressor 21 and the usage-side compressor 62 change, noises are emitted from the compressors 21, 62 whose operating capacities have changed. Particularly, since the usage-side unit 4 having the usage-side compressor 62 is installed indoors, the noise outputted from the usage-side compressor 62 is harsh to the user indoors.

In view of this, when the capacity of the usage-side compressor 62 is varied while the hot-water supply operation or another usual operation is being performed, the usage-side controller 12 performs a control for incrementally varying the operating capacity of the usage-side compressor 62 (hereinbelow referred to as usage-side capacity variation control) by incrementally varying the usage-side condensation target temperature Tc2s. Furthermore, when the usage-side compressor 62 is undergoing usage-side capacity variation control, the heat source-side controller 19 performs a control for incrementally varying the operating capacity of the heat source-side compressor 21 (hereinbelow referred to as heat source-side capacity variation control) by incrementally varying the heat source-side condensation target temperature Tc1s.

Specifically, in the usage-side refrigerant circuit 40, when the usage-side capacity variation control for reducing the operating capacity of the usage-side compressor 62 is performed by the usage-side controller 12 (in other words, at this time, the usage-side condensation target temperature Tc2s is incrementally lowered), in the heat source-side refrigerant circuit 20, the heat source-side controller 19 performs heat source-side capacity variation control for increasing the operating capacity of the heat source-side compressor 21 by incrementally raising the heat source-side condensation target temperature Tc1s. Conversely, in the usage-side refrigerant circuit 40, when the usage-side capacity variation control for increasing the operating capacity of the usage-side compressor 62 is performed by the usage-side controller 12 (in other words, at this time, the usage-side condensation target temperature Tc2s is incrementally raised), in the heat source-side refrigerant circuit 20, the heat source-side controller 19 performs heat source-side capacity variation control for reducing the operating capacity of the heat source-side compressor 21 by incrementally lowering the heat source-side condensation target temperature Tc1s.

With the control described above, a balance in compressor capabilities can be maintained between the usage-side unit 4 having the usage-side compressor 62 and the heat source unit 2 having the heat source-side compressor 21, and the capacity total values of both compressors 21, 62 can be maintained as substantially uniform for the entire heat pump system 1. For example the usage-side capacity variation control is performed for incrementally lowering the operating capacity in the usage-side compressor 62, but when only control is performed so as to bring the operating capacity in the heat source-side compressor 21 to a specified capacity, only the operating capacity of the usage-side compressor 62 decreases, the capability of the usage-side compressor 62 decreases, and the compressor capability of the entire heat pump system 1 is insufficient. However, when the usage-side capacity variation control for lowering the capacity, for example, is performed in the usage-side compressor 62 as described above, the heat source-side capacity variation control for raising the capacity in the heat source-side compressor 21 is performed, whereby the amount of capacity reduction in the compressor of the usage-side unit 4 can be compensated in the heat source unit 2 by the capacity increase in the heat source-side compressor 21 even if the compressor capability in the usage-side unit 4 has decreased due to the capacity decrease in the usage-side compressor 62.

The respective variation amounts, time intervals, and other characteristics of the usage-side condensation target temperature Tc2s and heat source-side condensation target temperature Tc1s which vary incrementally during the usage-side capacity variation control and the heat source-side capacity variation control may suitably decided in advance by written calculations, simulations, experiments, or other methods on the basis of information pertaining to the refrigerant circuits (e.g., refrigerant characteristics, etc.) or information pertaining to the compressors 21, 62 (e.g., the maximum operating capability values of the compressors 21, 62, the allowable active ranges of the operating frequencies of the compressors 21, 62, etc.); or they may be suitably decided by functions in accordance with occasional states of each of the refrigerant circuits 20, 40, for example. As a specific example, for the respective variation amounts of the usage-side condensation target temperature Tc2s and the heat source-side condensation target temperature Tc1s, the values could be in a range of about 1° C. to 10° C. at one level, and the time intervals could be 20 seconds or more. The usage-side condensation target temperature Tc2s and the heat source-side condensation target temperature Tc1s would thereby increase or decrease 5° C. every 20 seconds, for example. Particularly, the variation amount of the heat source-side condensation target temperature Tc1s is preferably decided based on the variation amount of the usage-side condensation target temperature Tc2s, out of consideration for equilibrium in capability between the usage-side unit 4 and the heat source unit 2.

Furthermore, the respective variation amounts of the usage-side condensation target temperature Tc2s and the heat source-side condensation target temperature Tc1s result in loud noises emitted when the operating capacity of the usage-side compressor 62 suddenly increases. Therefore, when the operating capacity of the usage-side compressor 62 is raised during usage-side capacity variation control, the usage-side condensation target temperature Tc2s is raised slowly and incrementally, and the heat source-side condensation target temperature Tc1s is lowered slowly and incrementally. The time intervals by which the usage-side condensation target temperature Tc2s and the heat source-side condensation target temperature Tc1s vary at this time are greater than the time intervals by which the usage-side condensation target temperature Tc2s and the heat source-side condensation target temperature Tc1s vary when the operating capacity of the usage-side compressor 62 is incrementally lowered and the operating capacity of the heat source-side compressor 21 is incrementally raised. In other words, when the usage-side condensation target temperature Tc2s is incrementally lowered, the operating capacity of the usage-side compressor 62 decreases more quickly than when the capacity is incrementally increased.

During usage-side capacity variation control, the operating capacity of the usage-side compressor 62 is limited to a predetermined capacity or lower. After the usage-side capacity variation control, there is no longer a limit on the operating capacity of the usage-side compressor 62 to the predetermined capacity or lower. In other words, after the usage-side capacity variation control has been performed for a predetermined time duration, the usage-side controller 12 controls the operating capacity of the usage-side compressor 62 without limiting it to a predetermined capacity or lower (hereinbelow referred to as capacity non-limiting control). When capacity non-limiting control is being performed, the heat source-side controller 19 performs a control for decreasing the operating capacity of the heat source-side compressor 21 by lowering the heat source-side condensation target temperature Tc1s to be lower than during usage-side capacity variation control (i.e. during heat source-side capacity variation control). The capability of the heat source-side compressor 21 is thereby lowered in capacity non-limiting control, but the operating capacity of the usage-side compressor 62 increases higher than in usage-side capacity variation control due to the operating capacity no longer being limited. Consequently, the capability of the usage-side compressor 62 increases. Therefore, a balance of compressor capability in the entire heat pump system 1 is maintained uniformly in usage-side capacity variation control and in capacity non-limiting control performed thereafter.

Figure 5:
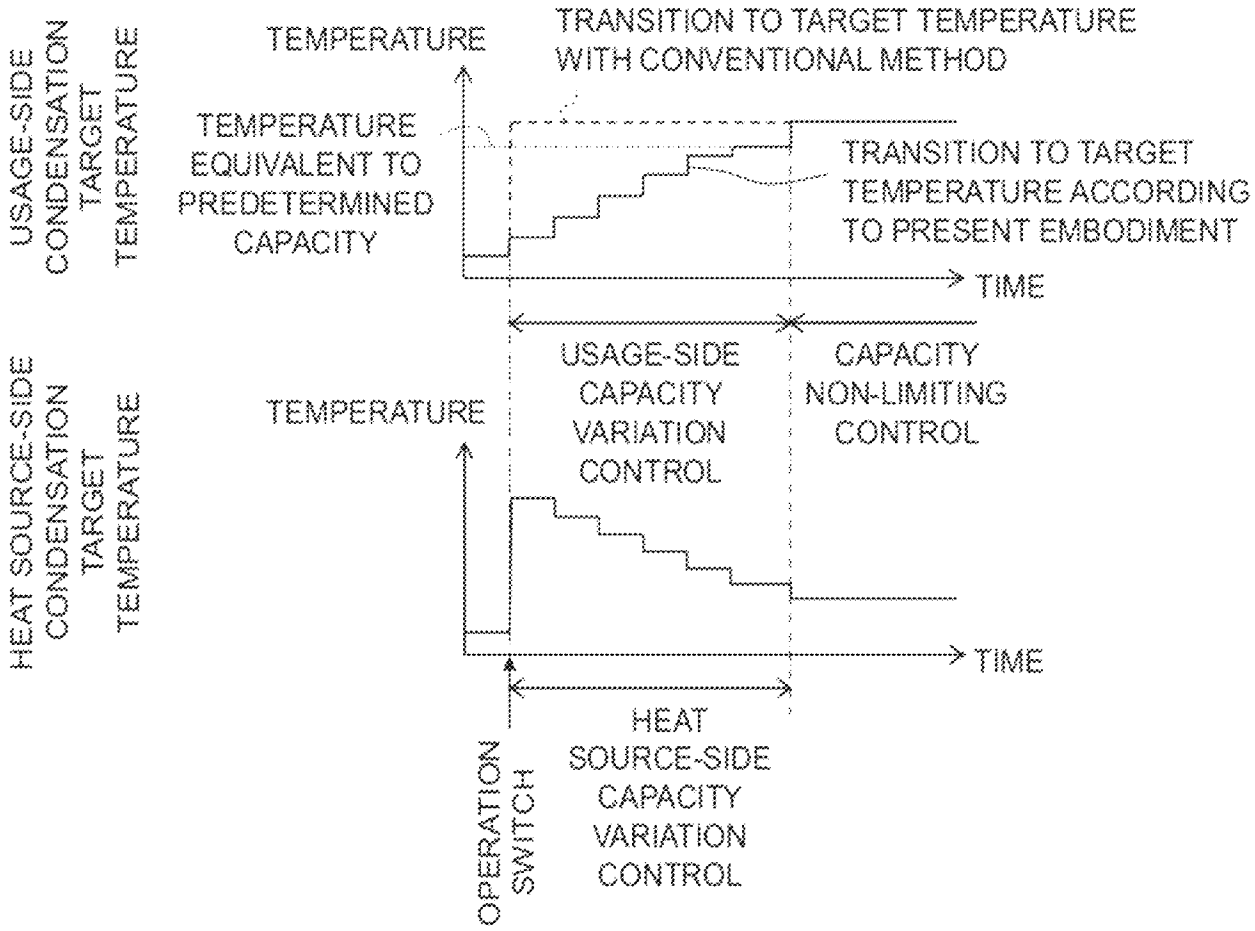
FIG. 5 is a schematic diagram showing the usage-side condensation target temperature and the heat source-side condensation target temperature which vary incrementally during the usage-side capacity variation control, capacity non-limiting control, and heat source-side capacity variation control according to the present embodiment.

FIG. 5 shows a schematic diagram of the progression over time of the usage-side condensation target temperature Tc2s and the heat source-side condensation target temperature Tc1s during the usage-side capacity variation control, heat source-side capacity variation control, and capacity non-limiting control described above. During the usage-side capacity variation control in the usage-side unit 4, the value of the usage-side condensation target temperature Tc2s incrementally rises and falls at predetermined time intervals while being limited to or below a temperature equivalent to a predetermined capacity, as shown by the solid lines of FIG. 5. The solid lines of FIG. 5 indicate a case in which this value is raised incrementally. During this time, heat source-side capacity variation control is performed in the heat source unit 2, and the heat source-side condensation target temperature Tc1s varies along with the incremental variation of the usage-side condensation target temperature Tc2s. In FIG. 5, the heat source-side condensation target temperature Tc1s is incrementally lowered because the usage-side condensation target temperature Tc2s is incrementally raised. After usage-side capacity variation control transitions to capacity non-limiting control, the usage-side condensation target temperature Tc2s is raised to or above a temperature equivalent to the predetermined capacity in FIG. 5, and the heat source-side condensation target temperature Tc1s is lowered.

The usage-side capacity variation control and the heat source-side capacity variation control described above are initiated when there is a change in the operation specifics, such as the heat pump system 1 transitioning to the hot-water supply operation from another operation besides the hot-water supply operation, for example, when the low-noise mode button 96*a* of the remote controller 90 has been pressed (FIG. 5). When there is a change in the operation specifics, there are cases in which the operating capacity of the usage-side compressor 62 must be suddenly increased above what it had theretofore been. In such cases, the usage-side capacity variation control and the heat source-side capacity variation control according to the present embodiment are preferably performed.

The usage-side condensation target temperature Tc2s in a conventional method is shown by the dotted lines in FIG. 5. In the conventional method, when there is a change in the operation specifics, the usage-side condensation target temperature Tc2s suddenly increases, and the operating capacity therefore suddenly increases as well.

—Flow of Overall Action of Heat Pump System 1—

Figure 6:
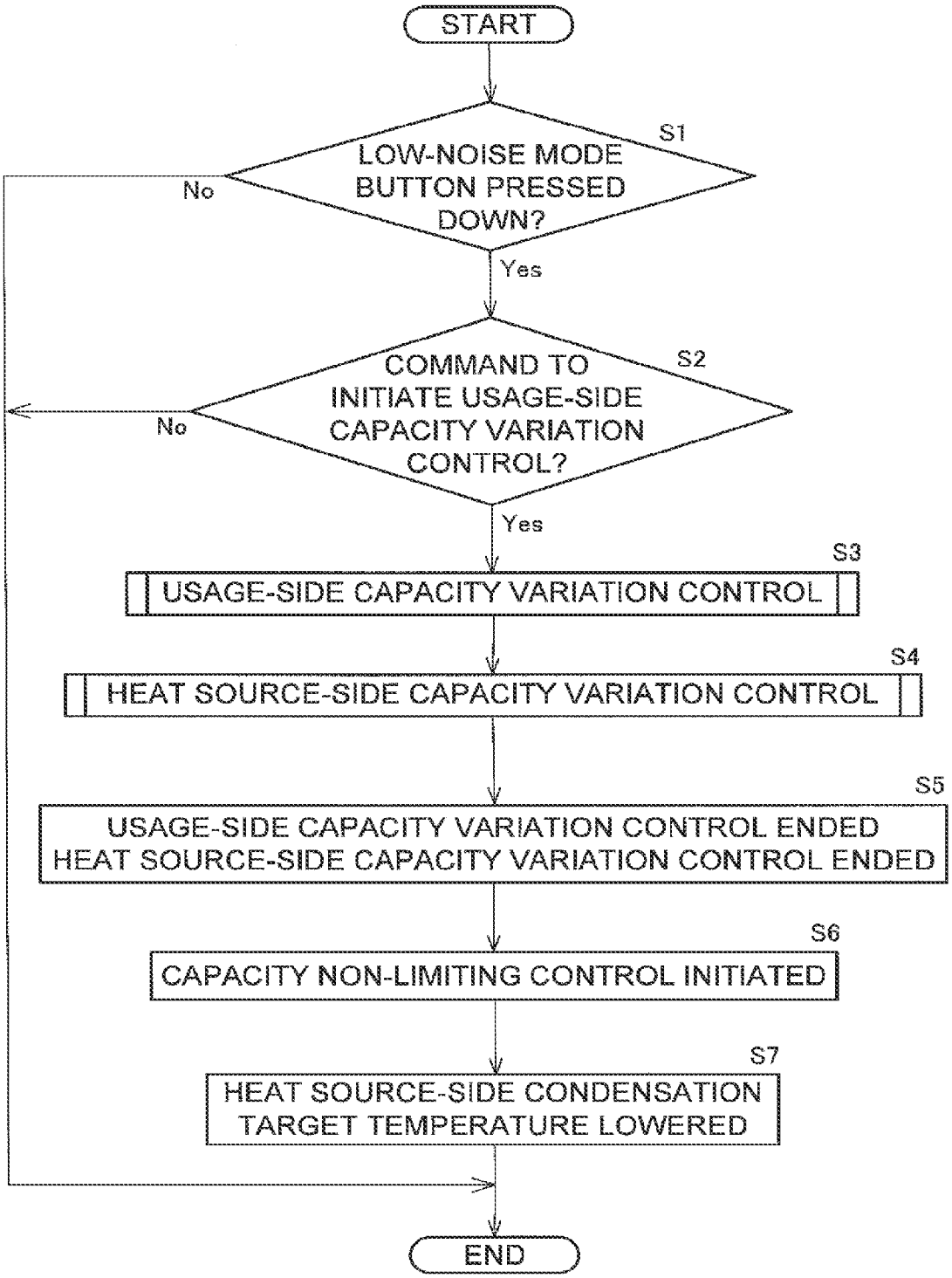
FIG. 6 is a flowchart showing the flow of the overall action of the heat pump system according to the present embodiment.

FIG. 6 is a flowchart showing the flow of the overall action of the heat pump system 1 according to the present embodiment.

Steps S1 to S4: The low-noise mode button 96*a* of the remote controller 90 is pressed down (Yes in S1). In this state, in cases in which the usage-side correspondence unit 11 of the usage-side unit 4 has received a command to initiate usage-side capacity variation control (Yes in S2) due to a change in the operation specifics, such as the heat pump system 1 transitioning to the hot-water supply operation from another operation besides the hot-water supply operation, the usage-side controller 12 performs the usage-side capacity variation control of FIG. 7 (S3), and the heat source-side controller 19 of the heat source-side unit 2 performs the heat source-side capacity variation control of FIG. 8 (S4). The flows of the action of usage-side capacity variation control and the action of heat source-side capacity variation control will be described hereinafter.

Step S5: In step S24 of FIG. 7 (described hereinafter) and step S39 of FIG. 8 (described hereinafter), in cases in which there has been a command to end usage-side capacity variation control issued via the low-noise mode button 96*a* or another button of the remote controller 90, for example (Yes in S24, Yes in S39), the usage-side controller 12 ends usage-side capacity variation control and the heat source-side controller 19 ends heat source-side capacity variation control.

Step S6: After usage-side capacity variation control has ended, the usage-side controller 12 performs capacity non-limiting control on the usage-side compressor 62. In other words, the usage-side controller 12 dispels the capacity upper limit on the usage-side compressor 62, which had been set during usage-side capacity variation control, and brings the usage-side condensation target temperature Tc2s to a specified value higher than during usage-side capacity variation control. The usage-side controller 12 then performs operating capacity control on the usage-side compressor 62 so that the condensation temperature Tc2 of the usage-side refrigerant reaches the usage-side condensation target temperature Tc2s, which is a specified value.

Step S7: The heat source-side controller 19 also decides a corrective value of the heat source-side condensation target temperature Tc1s during heat source-side capacity variation control on the basis of the usage-side condensation target temperature Tc2s according to step S6. The heat source-side controller 19 then makes a correction for lowering the heat source-side condensation target temperature Tc1s to a value that is lower than during usage-side capacity variation control, i.e. during heat source-side capacity variation control by the corrective value.

—Flow of Usage-Side Capacity Variation Control—

Figure 7:
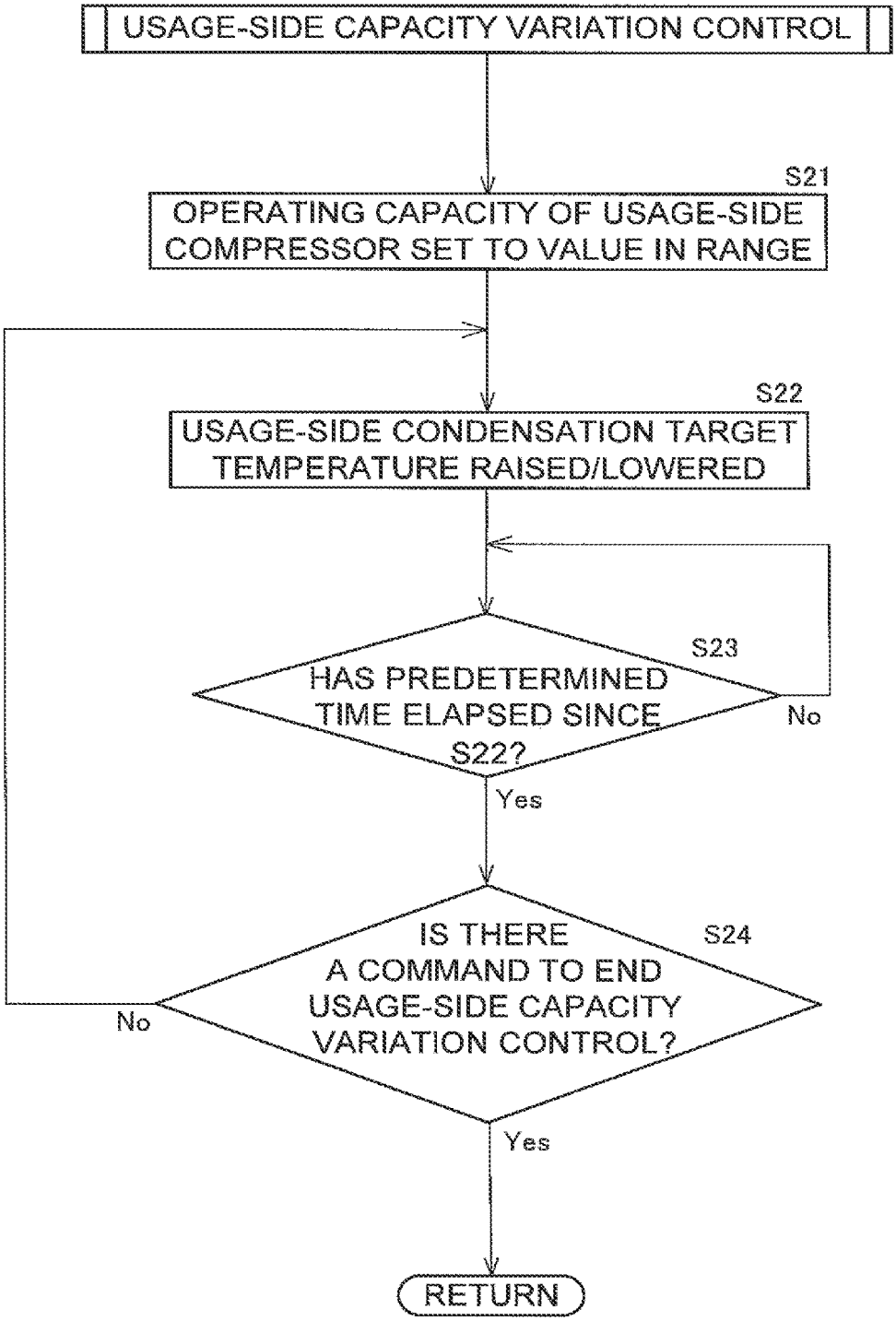
FIG. 7 is a flowchart showing the flow of the action of the usage-side capacity variation control according to FIG. 6.

FIG. 7 is a flowchart showing the flow of usage-side capacity variation control according to the present embodiment.

Steps S21 to S24: The usage-side controller 12 sets the capacity upper limit value of the usage-side compressor 62 to a value in a range for usage-side capacity variation control (S21). The usage-side controller 12 then raises or lowers the usage-side condensation target temperature on the basis of the current condensation temperature Tc2 of the usage-side refrigerant or another factor, for example, so that the operating capacity of the usage-side compressor 62 varies within the set capacity upper limit value (S22). This action of step S22 is performed with every elapse of a predetermined time duration (e.g. 20 seconds) after the varying of the usage-side condensation target temperature Tc2s (Yes in S23), until the usage-side correspondence unit 11 receives a command to end usage-side capacity variation control (No in S24). In cases in which the predetermined time duration (e.g. 20 seconds) has not elapsed since the varying of the usage-side condensation target temperature Tc2s (No in S23), the current usage-side condensation target temperature Tc2s is maintained.

Since the usage-side condensation target temperature Tc2s is varied incrementally at predetermined time intervals by the actions of these steps S21 to S24, the operating capacity of the usage-side compressor 62 also varies incrementally.

In FIG. 7, the capacity upper limit value of the usage-side compressor is set when usage-side capacity variation control is initiated, but the capacity upper limit value of the usage-side compressor may be varied within a range for usage-side capacity variation control at constant time intervals.

—Flow of Heat Source-Side Capacity Variation Control—

Figure 8:
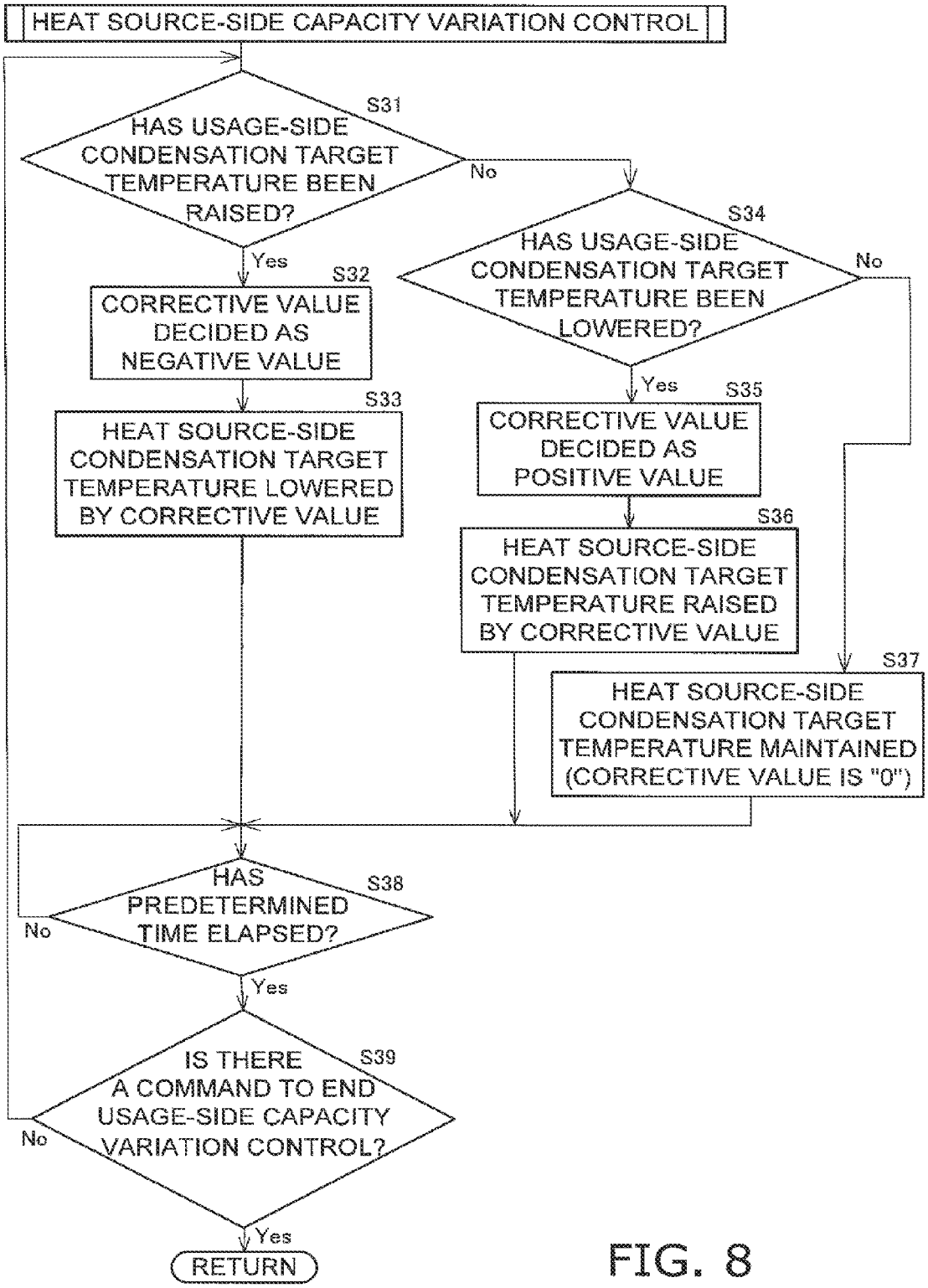
FIG. 8 is a flowchart showing the flow of the action of the heat source-side capacity variation control according to FIG. 6.

FIG. 8 is a flowchart showing the flow of heat source-side capacity variation control according to the present embodiment.

Steps S31 to S33: in the usage-side capacity variation control described above, when the usage-side condensation target temperature Tc2s has been raised (Yes in S31), the heat source-side controller 19 decides the corrective value of the heat source-side condensation target temperature Tc1s as a negative value (S32). The heat source-side condensation target temperature Tc1s is thereby lowered to a value lower than the current heat source-side condensation target temperature Tc1s by the corrective value (S33).

Steps S34 to S36: In usage-side capacity variation control, when the usage-side condensation target temperature Tc2s has been lowered (Yes in S34), the heat source-side controller 19 decides the corrective value of the heat source-side condensation target temperature Tc1s as a positive value (S35). The heat source-side condensation target temperature Tc1s is thereby raised to a value higher than the current heat source-side condensation target temperature Tc1s by the corrective value (S36).

Step S37: In usage-side capacity variation control, when the condensation temperature Tc2 of the usage-side refrigerant has not been changed (No in S34), the heat source-side controller 19 sets the corrective value of the heat source-side condensation target temperature Tc1s to "0." The current heat source-side condensation target temperature Tc1s is thereby maintained.

Step S38 to S39: The actions of the steps S31 to S37 described above are performed with every elapse of a predetermined time duration (e.g., 20 seconds) after the varying of the heat source-side condensation target temperature Tc1s (Yes in S38), until the heat source-side correspondence unit 18 receives a command to end usage-side capacity variation control (No in S39). In cases in which the predetermined time duration (e.g. 20 seconds) has not elapsed since the varying of the heat source-side condensation target temperature Tc1s (No in S38), the current heat source-side condensation target temperature Tc1s is maintained.

Since the heat source-side condensation target temperature Tc1s is varied incrementally at predetermined time intervals by the actions of these steps S31 to S39 while usage-side capacity variation control is being performed, the operating capacity of the heat source-side compressor 21 also varies incrementally.

<Characteristics>

The heat pump system 1 has the following characteristics.

(1)

According to the heat pump system 1, the heat source unit 2 is installed outdoors and the usage-side unit 4 is installed indoors. In other words, the usage-side unit 4, which has the usage-side compressor 62 which is a source of noise, is installed indoors. However, in this heat pump system 1, when the operating capacity of the usage-side compressor 62 is varied, usage-side capacity variation control is performed for varying the operating capacity of the usage-side compressor 62 not suddenly but incrementally. Therefore, the noise outputted from the usage-side compressor 62 is emitted slowly, due to the incremental varying of the operating capacity of the usage-side compressor 62. Consequently, it is possible to prevent the noises emitted along with the varying of the operating capacity of the usage-side compressor 62 from being harsh.

(2)

According to the heat pump system 1, the usage-side condensation target temperature Tc2s varies incrementally during usage-side capacity variation control, whereby the operating capacity of the usage-side compressor 62 varies incrementally. Therefore, the operating capacity of the usage-side compressor 62 can be varied incrementally by a simple method.

(3)

According to the heat pump system 1, when usage-side capacity variation control is preformed fir incrementally varying the operating capacity of the usage-side compressor 62, the operating capacity is incrementally varied not only in the usage-side compressor 62 but in the heat source-side compressor 21 as well. Therefore, a balance can be maintained between the capability of the usage-side compressor 62 and the capability of the heat source-side compressor 21.

(4)

According to the heat pump system 1, the heat source-side controller 19 performs capacity control on the heat source-side compressor 21 so that the condensation temperature Tc of the heat source-side refrigerant in the usage-side heat exchanger 41 reaches the heat source-side condensation target temperature Tc1s, and also performs heat source-side capacity variation control by incrementally varying the heat source-side condensation target temperature Tc1s. In other words, in the heat source unit 2, the operating capacity of the heat source-side compressor 21 varies incrementally due to the incremental varying of the heat source-side condensation target temperature Tc1s in the heat source-side refrigerant. Therefore, the operating capacity of the heat source-side compressor 21 can be incrementally varied by a simple method.

(5)

According to the heat pump system 1, when the operating capacity of the usage-side compressor 62 decreases during usage-side capacity variation control, in the heat source unit 2, the operating capacity of the heat source-side compressor 21 increases due to the heat source-side condensation target temperature Tc1s being raised. Thereby, the compressor capability of the entire heat pump system 1 can be maintained even when the compressor capacity of the usage-side unit 4 decreases, by raising the compressor capacity of the heat source unit 2.

(6)

In this heat pump system 1, the operating capability of the usage-side compressor 62 is limited to a predetermined quantity or lower during usage-side capacity variation control, but in capacity non-limiting control which is performed after the usage-side capacity variation control, the operating capacity of the usage-side compressor 62 ceases to be limited and increases. Therefore, during capacity non-limiting control, the compressor capability of the usage-side unit 4 can be ensured by the usage-side unit 4. Consequently, in this case, the balance of compressor capabilities in the entire heat pump system 1 can be maintained by reducing the operating capacity of the heat source-side compressor 21.

(7)

According to this heat pump system 1, when a command to initiate usage-side capacity variation control is issued by the user pressing the low-noise mode button 96*a* associated with the remote controller 90 and the operating state of the system 1 then changes, the operating capacity of the usage-side compressor 62 varies incrementally. Therefore, the heat pump system 1 can perform an operation for suppressing the noises outputted from the usage-side compressor 62 in accordance with the preferences of the user who is using the system 1.

<Modifications>

(A)

With the heat pump system 1 described above, a case was described in which the operating capacity of the heat source-side compressor 21 is incrementally varied by incrementally varying the heat source-side condensation target temperature Tc1s of the heat source-side refrigerant during heat source-side capacity variation control. However, the heat source-side controller 19 may also vary the operating capacity of the heat source-side compressor 21 by incrementally varying a usage-side evaporation target temperature Te2s of the usage-side refrigerant instead of the heat source-side condensation target temperature Tc1s of the heat source-side refrigerant.

In this case, the usage-side controller 12 performs capacity control on the heat source-side compressor 21 during the hot-water supply operation so that an evaporation temperature Te2 of the usage-side refrigerant reaches the usage-side evaporation target temperature Tc2s, the usage-side refrigerant being in the usage-side heat exchanger 41 functioning as an evaporator of the usage-side refrigerant. The heat source-side controller 19 sets the usage-side evaporation target temperature Te2s as a value that can be varied by the target aqueous medium outlet temperature Tw1s or the usage-side condensation target temperature Tc2s used by the usage-side controller 12 during usage-side capacity variation control. The operating capacity of the heat source-side compressor 21 can thereby be incrementally varied by a simple method, similar to the embodiment described above.

During usage-side capacity variation control in the usage-side unit 4, when the operating capacity of the usage-side compressor 62 incrementally decreases due to the usage-side condensation target temperature Tc2s being incrementally lowered, the heat source-side controller 19 performs heat source-side capacity variation control for increasing the operating capacity of the heat source-side compressor 21 by incrementally raising the usage-side evaporation target temperature Te2s. Conversely, when the operating capacity of the usage-side compressor 62 incrementally increases due to the usage-side condensation target temperature Tc2s being incrementally raised, the heat source-side controller 19 performs heat source-side capacity variation control for reducing the operating capacity of the heat source-side compressor 21 by incrementally lowering the usage-side evaporation target temperature Te2s. It is thereby possible to maintain compressor capability in the entire heat pump system 1 by raising the compressor capability of the heat source unit 2, even when the compressor capability in the usage-side unit 4 has decreased, for example, similar to the embodiment described above.

In the usage-side unit 4, when usage-side capacity variation control ends and capacity non-limiting control is performed, the heat source-side controller 19 reduces the operating capacity of the heat source-side compressor 21 by lowering the usage-side evaporation target temperature Tc2s to be less than during usage-side capacity variation control. A balance of capability in the entire heat pump system 1 can thereby be maintained.

(B)

The usage-side capacity variation control described above is preferably performed particularly during a predetermined time interval following the start of the operation of the usage-side compressor 62, i.e., during a predetermined time interval following the startup of the usage-side compressor 62. This is because when the usage-side compressor 62 in a stopped state is then started up, the operating capacity of the usage-side compressor 62 suddenly increases, the state therefore suddenly changes from no noise being emitted from the usage-side compressor 62 to noise being emitted, and in particularly, it is likely that the noise will be considered unpleasant. However, due to the usage-side capacity variation control according to the present embodiment being performed during the predetermined time duration following the startup of the usage-side compressor 62, or specifically at least during the time period in which the rotational speed of the usage-side compressor 62 is increasing, the rotational speed of the usage-side compressor 62 gradually increases along with the change in operating capacity. Therefore, it is possible to suppress sudden loud noises.

However, as described above, when usage-side capacity variation control is performed when the usage-side compressor 62 is started up, the capabilities of the compressors of the entire heat pump system 1 at startup are suppressed. In view of this, when the usage-side compressor 62 begins operating, the heat source-side controller 19 preferably temporarily sets the heat source-side condensation target temperature Tc1s to a predetermined temperature or higher and then performs a control for incrementally lowering the heat source-side condensation target temperature Tc1s until the predetermined temperature is reached. In other words, when the usage-side compressor 62 begins to operate, in the heat source unit 2, the capability of the heat source-side compressor 21 gradually decreases after having been temporarily increased. Thereby, when the heat pump system 1 starts up, even if the sudden increase in the operating capacity of the usage-side compressor 62 is suppressed in order to prevent noise, the capability insufficiency in the usage-side unit 4 can be compensated in the heat source unit 2. Therefore, the heat pump system 1 can be reliably started up while preventing the noise outputted from the usage-side compressor 62 from being harsh.

Figure 9:
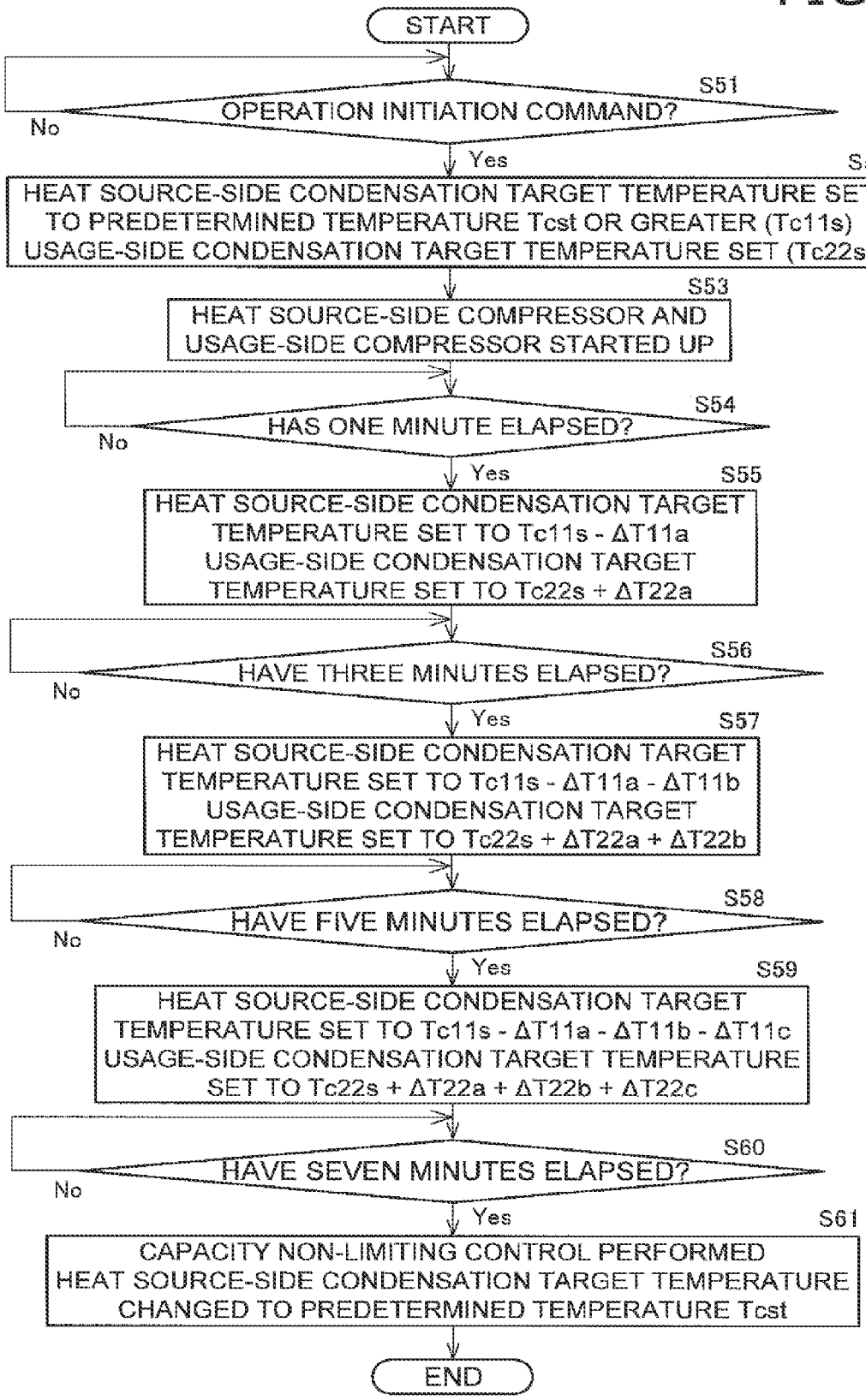
FIG. 9 is a flowchart showing the flow of the action of the heat pump system according to Modification (B).

FIG. 9 is a flowchart showing the flow of the action of the heat pump system according to Modification (B).

Steps S51 to S52: When a command to initiate operation of the heat pump system 1 is issued via the remote controller 90 (Yes in S51), the heat source-side controller 19 sets the heat source-side condensation target temperature Tc1s to a temperature Tc11s equal to or greater than a predetermined temperature Tcst (Tc1s=Tc11s). The usage-side controller 12 sets the usage-side condensation target temperature Tc2s to a temperature Tc22s (S52, Tc2s=Tc22s). At this time, the heat source-side condensation target temperature Tc1s is higher than the usage-side condensation target temperature Tc2s, and the usage-side condensation target temperature Tc2s is a small value (Tc1s>Tc2s, i.e. Tc11s>Tc22s).

Step S53: The heat source-side controller 19 starts up the heat source-side compressor 21 and controls the operating capacity of the heat source-side compressor 21 so that the condensation temperature Tc1 of the heat source-side refrigerant reaches the heat source-side condensation target temperature Tc1s set in step S52. The usage-side controller 12 starts up the usage-side compressor 62 and controls the operating capacity of the usage-side compressor 62 so that the condensation temperature Tc2 of the usage-side refrigerant reaches the usage-side condensation target temperature Tc2s set in step S52.

Steps S54 to S55: After one minute has elapsed since the startup in step S53 (Yes in S54), the usage-side controller 12 increases the usage-side condensation target temperature Tc2s by ΔT22*a*. The usage-side condensation target temperature Tc2s thereby becomes "Tc22s+ΔT22*a*" (S55), and the operating capacity of the usage-side compressor 62 is controlled so that the condensation temperature Tc2 of the usage-side refrigerant becomes "Tc22s+ΔT22*a*." The heat source-side controller 19 reduces the heat source-side condensation target temperature Tc1s by ΔT11*a*. The heat source-side condensation target temperature Tc1s thereby becomes "Tc11s−ΔT11*a*" (S55), and the operating capacity of the heat source-side compressor 21 is controlled so that the condensation temperature Tc1 of the heat source-side refrigerant becomes "Tc11s−ΔT11*a*."

Steps S56 to S57: After three minutes have elapsed since the startup in step S53 (Yes in S56), the usage-side controller 12 further increases the usage-side condensation target temperature Tc2s from step S55 by ΔT22*b*. The usage-side condensation target temperature Tc2s thereby becomes "Tc22s+ΔT22*a*+ΔT22*b*" (S57), and the operating capacity of the usage-side compressor 62 is controlled so that the condensation temperature Tc2 of the usage-side refrigerant becomes "Tc22s+ΔT22*a*+T22*b*." The heat source-side controller 19 further reduces the heat source-side condensation target temperature Tc1s from step S55 by ΔT11*b*. The heat source-side condensation target temperature Tc1s thereby becomes "Tc11s−ΔT11*a*−ΔT11*b*" (S57), and the operating capacity of the heat source-side compressor 21 is controlled so that the condensation temperature Tc1 of the heat source-side refrigerant becomes "Tc11s−ΔT11*a*−ΔT11*b*."

Steps S58 to S59: After five minutes have elapsed since the startup in step S53 (Yes in S58), the usage-side controller 12 further increases the usage-side condensation target temperature Tc2s from step S57 by ΔT22*c*. The usage-side condensation target temperature Tc2s thereby becomes "Tc22s+ΔT22*a*+ΔT22*b*+ΔT22*c*" (S59), and the operating capacity of the usage-side compressor 62 is controlled so that the condensation temperature Tc2 of the usage-side refrigerant becomes "Tc22s+ΔT22*a*+ΔT22*b*+ΔT22*c*." The heat source-side controller 19 further reduces the heat source-side condensation target temperature Tc1s from step S57 by ΔT11*c*. The heat source-side condensation target temperature Tc1s thereby becomes "Tc11s−ΔT11*b*−ΔT11*c*" (S59), and the operating capacity of the heat source-side compressor 21 is controlled so that the condensation temperature Tc1 of the heat source-side refrigerant becomes "Tc11s−ΔT11*a*−ΔT11*b*−ΔT11*c*."

Steps S60 to S61: After seven minutes have elapsed since the startup in step S53 (Yes in S60), the usage-side controller 12 ends the usage-side capacity variation control that was being performed from step S52 to step S59 and performs capacity non-limiting control. The heat source-side controller 19 then changes the heat source-side condensation target temperature Tc1s to a predetermined temperature Tsct, and performs operating capacity control on the heat source-side compressor 21 (S61).

As shown in Modification (A), when the usage-side evaporation target temperature Te2s of the usage-side refrigerant is incrementally varied during heat source-side capacity variation control, the heat source-side controller 19 preferably temporarily sets the usage-side evaporation target temperature Te2s instead of the heat source-side condensation target temperature Tc1s to a predetermined temperature or greater when the usage-side compressor 62 starts up, and then incrementally lowers the usage-side evaporation target temperature Te2s until the predetermined temperature is reached.

When the corrective value of the heat source-side compressor 21 is established in FIG. 9, the corrective value may be suitably changed according to the result of comparing the current operating capacity of the usage-side compressor 62 and the capacity upper limit value of the usage-side compressor 62, and also the result of comparing the current condensation temperature Tc2 of the usage-side refrigerant and the usage-side condensation target temperature Tc2s. As an example, in cases in which the current operating capacity of the usage-side compressor 62 is equal to or less than the capacity upper limit value of the usage-side compressor 62 and the current condensation temperature Tc2 of the usage-side refrigerant is higher than the usage-side condensation target temperature Tc2s (Tc2>Tc2s), the capability of the usage-side compressor 62 is currently being outputted sufficiently, and a corrective value is therefore decided so as to lower the operating capacity of the heat source-side compressor 21 in the heat source unit 2. In cases in which the current condensation temperature Tc2 of the usage-side refrigerant is less than the usage-side condensation target temperature Tc2s (Tc2<Tc2s), the capability of the usage-side compressor 62 tends to be currently insufficient, and the corrective value is therefore decided so that the operating capacity of the heat source-side compressor 21 is raised in the heat source unit 2.

(C)

With the heat pump system 1 described above, a case was described in which the usage-side controller 12 performs usage-side capacity variation control when the low-noise mode button 96*a* of the remote controller 90 has been pressed and the operating specifics of the system have changed further. However, the usage-side capacity variation control may be initiated using the pressing of the low-noise mode button 96*a* of the remote controller 90 as a trigger.

(D)

With the heat pump system 1 described above, a case was described in which one usage-side unit 4 is connected to one heat source unit 2 as shown in FIG. 1. However, the number of usage-side units 4 connected to the heat source unit 2 is not limited to one, and may be a plurality.

(E)

With the heat pump system 1 described above, a case was described in which a usage-side unit 4 that uses an aqueous medium is connected to the heat source unit 2. However, the heat pump system according to the present invention may further include an air conditioner for using the heat source-side refrigerant to condition air, in addition to the heat source unit 2 and the usage-side unit 4 that uses the aqueous medium. In this case, the air conditioner is connected to the heat source unit 2, similar to the usage-side unit.

INDUSTRIAL APPLICABILITY

If the present invention is used, then in a heat pump system in which an aqueous medium can be heated using a heat pump cycle, the user will not be subjected to any harsh noise when capacity varies in the usage-side compressor in the usage-side unit installed indoors.

What is claimed is:

1. A heat pump system comprising:

a heat source unit having a heat source-side compressor configured to compress a heat source-side refrigerant and a heat source-side heat exchanger configured to function as an evaporator of the heat source-side refrigerant;

a usage side unit connected to the heat source unit, the usage side unit having a capacity-variable-type usage-side compressor configured to compress a usage-side refrigerant, a usage-side heat exchanger configured to function as a radiator of the heat source-side refrigerant and functioning as an evaporator of the usage-side refrigerant; and a refrigerant-water heat exchanger configured to function as a radiator of the usage-side refrigerant and configured to heat an aqueous medium, the heat source-side compressor, the heat source-side heat exchanger, and the usage-side heat exchanger forming parts of a heat source-side refrigerant circuit, the heat source-side compressor being a capacity-variable-type compressor, and the usage-side compressor, the usage-side heat exchanger, and the refrigerant-water heat exchanger forming parts of a usage-side refrigerant circuit;

a usage-side controller configured to perform a usage-side capacity variation control in which an operating capacity of the usage-side compressor is incrementally variable during a normal operation; and a heat source-side controller configured to monitor a condensation temperature of the heat source-side refrigerant in the usage-side heat exchanger and to control the heat source-side compressor such that the condensation temperature of the heat source-side refrigerant in the usage-side heat exchanger reaches a heat source-side condensation target temperature, the heat source-side controller being further configured to perform a heat source-side capacity variation control in which an operating capacity of the heat source-side compressor is incrementally varied by incrementally varying the heat source-side condensation target temperature when the usage-side controller is performing the usage-side capacity variation control, when the usage-side controller reduces operating capacity of the usage-side compressor during the usage-side capacity variation control, the heat source-side controller performing the heat source-side capacity variation control by raising the heat source-side condensation target temperature in order to increase operating capacity of the heat source-side compressor.

2. The heat pump system according to claim 1, wherein the usage-side controller is further configured to perform a capacity control on the usage-side compressor in which condensation temperature of the usage-side refrigerant in the refrigerant-water heat exchanger reaches a usage-side condensation target temperature, and the usage-side capacity variation control by incrementally varying the usage-side condensation target temperature.

3. The heat pump system according to claim 1, wherein the usage-side controller is further configured to perform the usage-side capacity variation control during a predetermined time duration following a start of operation of the usage-side compressor.

4. The heat pump system according to claim 1, wherein the usage-side controller is further configured to limit operating capacity of the usage-side compressor to a predetermined capacity or lower during the usage-side capacity variation control, and perform capacity non-limiting control in which operating capacity of the usage-side compressor is controlled without limiting operating capacity to the predetermined capacity or lower after the usage-side capacity variation control; and the heat source-side controller is further configured to perform a control in which operating capacity of the heat source-side compressor is reduced during the capacity non-limiting control by lowering the heat source-side condensation target temperature to a value lower than during the usage-side capacity variation control.

5. A heat pump system comprising:

a heat source unit having a heat source-side compressor configured to compress a heat source-side refrigerant and a heat source-side heat exchanger configured to function as an evaporator of the heat source-side refrigerant;

a usage-side unit connected to the heat source unit, the usage side unit having a capacity-variable-type usage-side compressor configured to compress a usage-side refrigerant, a usage-side heat exchanger configured to function as a radiator of the heat source-side refrigerant and functioning as an evaporator of the usage-side refrigerant, and a refrigerant-water heat exchanger configured to function as a radiator of the usage-side refrigerant and configured to heat an aqueous medium, the heat source-side compressor, the heat source-side heat exchanger, and the usage-side heat exchanger funning parts of a heat source-side refrigerant circuit, the heat source-side compressor being a capacity-variable-type compressor, and the usage-side compressor, the usage-side heat exchanger, and the refrigerant-water heat exchanger forming parts of a usage-side refrigerant circuit;

a usage-side controller configured to perform a usage-side capacity variation control in which an operating capacity of the usage-side compressor is incrementally variable during a normal operation; and a heat source-side controller configured to monitor an evaporation temperature of the usage-side refrigerant in the usage-side heat exchanger and control the heat source-side compressor such that evaporation temperature of the usage-side refrigerant in the usage-side heat exchanger reaches a usage-side evaporation target, temperature, the heat source-side controller being further configured perform a heat source-side capacity variation control in which an operating capacity of the heat source-side compressor is incrementally varied by incrementally varying the usage-side evaporation target temperature when the usage-side controller is performing the usage-side capacity variation control, when the usage-side controller reduces the operating capacity of the usage-side compressor during the usage-side capacity variation control, the heat source-side controller performing the heat source-side capacity variation control by raising the usage-side evaporation target temperature in order to increase the operating capacity of the heat source-side compressor.

6. The heat pump system according to claim 5, wherein the usage-side controller is further configured to limit operating capacity of the usage-side compressor to a predetermined capacity or lower during the usage-side capacity variation control, and perform capacity non-limiting control in which operating capacity of the usage-side compressor is controlled without limiting operating capacity to the predetermined capacity or lower after the usage-side capacity variation control; and the heat source-side controller is further configured to perform a control in which operating capacity of the heat source-side compressor is reduced during the capacity non-limiting control by lowering the usage-side evaporation target temperature to a value lower than during the usage-side capacity variation control.

7. The heat pump system according to claim 1, wherein the usage-side controller is further configured to perform the usage-side capacity variation control dining a predetermined time duration following a start of operation of the usage-side compressor; and the heat source-side controller is further configured to set the heat source-side condensation target temperature to a predetermined temperature or higher at the start of operation of the usage-side compressor, and thereafter incrementally lower the heat source-side condensation target temperature until the predetermined temperature is reached.

8. The heat pump system according to claim 1, further comprising:

a receiver configured to receive a command to initiate the usage-side capacity variation control, the usage-side controller being further configured to perform the usage-side capacity variation control when the receiver has received the command to initiate the usage-side capacity variation control.

9. The heat pump system according to claim 2, wherein the usage-side controller is further configured to perform the usage-side capacity variation control during a predetermined time duration following a start of operation of the usage-side compressor.

10. The heat pump system according to claim 5, wherein the usage-side controller is further configured to perform a capacity control on the usage-side compressor in which condensation temperature of the usage-side refrigerant in the refrigerant-water heat exchanger reaches a usage-side condensation target temperature, and the usage-side capacity variation control by incrementally varying the usage-side condensation target temperature.

11. The heat pump system according to claim 5, wherein the usage-side controller is further configured to perform the usage-side capacity variation control during a predetermined time duration following a start of operation of the usage-side compressor.

12. The heat pump system according to claim 5, wherein the usage-side controller is further configured to perform the usage-side capacity variation control during a predetermined time duration following a start of operation of the usage-side compressor; and the heat source-side controller is further configured to set the usage-side evaporation target temperature to a predetermined temperature or higher at the start of operation of the usage-side compressor, and thereafter incrementally lower the usage-side evaporation target temperature until the predetermined temperature is reached.

13. The heat pump system according to claim 5, further comprising:

a receiver configured to receive a command to initiate the usage-side capacity variation control, the usage-side controller being further configured to perform the usage-side capacity variation control when the receiver has received the command to initiate the usage-side capacity variation control.

14. The heat pump system according to claim 10, wherein the usage-side controller is further configured to perform the usage-side capacity on control during a predetermined time duration following a start of operation of the usage-side compressor.

* * * * *